US006641988B2

(12) United States Patent
Hakii

(10) Patent No.: US 6,641,988 B2
(45) Date of Patent: Nov. 4, 2003

(54) PHOTOGRAPHIC ELEMENT AND SILVER HALIDE PHOTOGRAPHIC LIGHT SENSITIVE MATERIAL

(75) Inventor: Takeshi Hakii, Hino (JP)

(73) Assignee: Konica Corporation (JP)

( * ) Notice: Subject to any disclaimer, the term of this patent is extended or adjusted under 35 U.S.C. 154(b) by 50 days.

(21) Appl. No.: 10/066,489

(22) Filed: Jan. 31, 2002

(65) Prior Publication Data

US 2002/0187443 A1 Dec. 12, 2002

(30) Foreign Application Priority Data

Feb. 7, 2001 (JP) ..... 2001-030907

(51) Int. Cl.[7] ..... G03C 1/46

(52) U.S. Cl. ..... 430/505; 430/543; 430/556; 430/557; 430/552; 430/553; 430/558; 430/546; 430/510; 430/512; 430/931

(58) Field of Search ..... 430/505, 543, 430/557, 558, 556, 552, 553, 546, 510, 512, 931

(56) References Cited

U.S. PATENT DOCUMENTS 6,183,945 B1 * 2/2001 Sato et al. ..... 430/543
6,291,144 B1 * 9/2001 Aylward et al. ..... 430/504
6,368,759 B1 * 4/2002 Bourdelais et al. ..... 430/505

* cited by examiner

*Primary Examiner*—Geraldine Letscher
(74) *Attorney, Agent, or Firm*—Muserlian, Lucas and Mercanti

(57) ABSTRACT

A photographic element is disclosed, comprising a yellow dye forming coupler, a magenta dye forming coupler and a cyan dye forming coupler, wherein spectral reflection absorption characteristics of a yellow dye, a magenta dye and a cyan dye which are formed of the yellow dye forming coupler, the magenta dye forming coupler and the cyan dye forming coupler, respectively, meet the following requirements:

$$110 \geqq \lambda\max(M) - \lambda\max(Y) \geqq 95,$$

$$80 \geqq \lambda\max(C) - \lambda\max(M) \geqq 70,$$

$$0.43 \geqq Abs_{600}(M) \geqq 0.38,$$

and $$0.48 \geqq Abs_{550}(C) \geqq 0.35.$$

14 Claims, No Drawings

PHOTOGRAPHIC ELEMENT AND SILVER HALIDE PHOTOGRAPHIC LIGHT SENSITIVE MATERIAL

FIELD OF THE INVENTION

The present invention relates to a photographic element and a silver halide photographic light sensitive material (hereinafter, also denoted simply as a photographic material) and in particular to a photographic element and a silver halide photographic material exhibiting improved color reproducibility, specifically, expanded color gamut of obtained dye images and enhanced suitability for a light source used for visual appreciation of dye images.

BACKGROUND OF THE INVENTION

Recently, various color imaging systems have become popular, including a silver halide photographic system, electrophotography, ink-jet printing and thermal transfer recording. Consumers demands for image qualities of silver halide photographic materials superior in productivity to other imaging systems have increased from year to year. Demand for high image quality include improvements in color reproduction, tone reproduction and sharpness. Specifically, with regard to color reproduction, there have been studies on improvements in spectral absorption characteristics of yellow, magenta and cyan dyes.

In the conventional design of spectral absorption characteristic of dyes, it was common to allow yellow dyes to have an absorption maximum in the vicinity of 450 nm, magenta dyes to have an absorption maximum in the vicinity of 550 nm and cyan dyes to have an absorption maximum in the vicinity of 650 nm. Thus, it was a general practice to maintain the difference in λmax between respective dyes to be an extent of 100 nm. Thereby, preferable yellow, magenta and cyan colors were maintained and shifting this balance to a larger extent was shown to cause failure in color. Recently, however, it was also proved that only such design philosophy was insufficient to achieve satisfactory color reproduction and there have been attempted various designs.

JP-A No. 63-153546 (hereinafter, the term, JP-A refers to an unexamined, published Japanese Patent Application) proposed a technique for controlling wavelengths of absorption maximums (λmax) of yellow, magenta and cyan dyes to expand the color gamut of obtained dye images and to minimize dependency on light sources used for visual appreciation of dye images. Thus, it was described in this disclosure that the spectral absorption band of the magenta dye was narrowed and the wavelength of the absorption maximum of the dye was fixed within an intended region. However, it was proved that when using a pyrazoloazole type magenta coupler satisfying the spectral absorption maximum taught in this disclosure, appearance of gray images were markedly varied under different light sources, i.e., dependence on a light source for visual appreciation was increased.

It is generally known that narrowing the spectral absorption band of an individual dye is advantageous to expand the color gamut but it also disadvantageously results in an increase of dependency on light sources for visual appreciation. It has therefore been considered to satisfy both criteria.

JP-A No. 10-83046 proposed a technique, in which narrowing an absorption band of a cyan dye was achieved by the use of a specified cyan coupler, thereby leading to expanded color gamut. However, it was proved that a balance of spectral absorptions of yellow, magenta and cyan dyes was not taken into account so that this technique was insufficient to achieve desired improvements.

SUMMARY OF THE INVENTION

In view of the foregoing, accordingly, it is an object of the present invention to provide a photographic element and a silver halide photographic material, which are superior in color reproduction, specifically in color gamut and suitability for a light source used in visual appreciation.

The foregoing object of the invention can be accomplished by the following photographic element and silver halide photographic material:

(1) A photographic element comprising a yellow dye forming coupler, a magenta dye forming coupler and a cyan dye forming coupler, wherein spectral reflection absorption characteristics of a yellow dye, a magenta dye and a cyan dye which are formed of the yellow dye forming coupler, the magenta dye forming coupler and the cyan dye forming coupler, respectively, meet the following requirements:

$$110 \geqq \lambda\max(M) - \lambda\max(Y) \geqq 95,$$

$$80 \geqq \lambda\max(C) - \lambda\max(M) \geqq 70,$$

$$0.43 \geqq Abs_{600}(M) \geqq 0.38,$$

and $$0.48 \geqq Abs_{550}(C) \geqq 0.35,$$

wherein λmax(Y) is a wavelength at an absorption maximum of the formed yellow dye, λmax(M) is a wavelength at an absorption maximum of the formed magenta dye and λmax(C) is a wavelength at an absorption maximum of the formed cyan dye; $Abs_{600}$ (M) is an absorbance at a wavelength of 600 nm of the magenta dye having 1.0 of an absorbance at the absorption maximum and $Abs_{550}$ (C) is an absorbance at a wavelength of 550 nm of the cyan dye having 1.0 of an absorbance at the absorption maximum;

(2) A photographic element comprising a yellow dye forming coupler, a magenta dye forming coupler and a cyan dye forming coupler, wherein spectral reflection absorption characteristics of a yellow dye, a magenta dye and a cyan dye which are formed of the yellow dye forming coupler, the magenta dye forming coupler and the cyan dye forming coupler, respectively, meet the following requirements:

$$108 \geqq \lambda\max(M) - \lambda\max(Y) \geqq 100,$$

$$80 \geqq \lambda\max(C) - \lambda\max(M) \geqq 70,$$

$$0.42 \geqq Abs_{600}(M) \geqq 0.40,$$

and $$0.46 \geqq Abs_{550}(C) \geqq 0.35,$$

wherein λmax(Y) is a wavelength at an absorption maximum of the formed yellow dye, λmax(M) is a wavelength at an absorption maximum of the formed magenta dye and λmax(C) is a wavelength at an absorption maximum of the formed cyan dye; $Abs_{600}$ (M) is an absorbance at a wavelength of 600 nm of the magenta dye having 1.0 of an absorbance at the absorption maximum and $Abs_{550}$ (C) is an absorbance at a wavelength of 550 nm of the cyan dye having 1.0 of an absorbance at the absorption maximum;

(3) A reflection-type or transmission-type silver halide photographic light sensitive material comprising on a refection or transmission support a blue-sensitive silver halide emulsion layer containing a yellow dye forming coupler, a green-sensitive silver halide emulsion layer containing a magenta dye forming coupler and a red-sensitive silver halide emulsion layer containing a cyan dye forming coupler, wherein spectral reflection absorption characteristics of a yellow dye, a magenta dye and a cyan dye which are formed of the yellow dye forming coupler, the magenta dye forming coupler and the cyan dye forming coupler, respectively, meet the following requirements:

$$110 \geqq \lambda max(M) - \lambda max(Y) \geqq 95,$$

$$80 \geqq \lambda max(C) - \lambda max(M) \geqq 70,$$

$$0.43 \geqq Abs_{600}(M) \geqq 0.38,$$

and $$0.48 \geqq Abs_{550}(C) \geqq 0.35,$$

wherein λmax(Y) is a wavelength at an absorption maximum of the formed yellow dye, λmax(M) is a wavelength at an absorption maximum of the formed magenta dye and λmax(C) is a wavelength at an absorption maximum of the formed cyan dye; $Abs_{600}$ (M) is an absorbance at a wavelength of 600 nm of the magenta dye having 1.0 of an absorbance at the absorption maximum and $Abs_{550}$ (C) is an absorbance at a wavelength of 550 nm of the cyan dye having 1.0 of an absorbance at the absorption maximum;

(4) A reflection-type or transmission-type silver halide photographic light sensitive material comprising on a refection or transmission support a blue-sensitive silver halide emulsion layer containing a yellow dye forming coupler, a green-sensitive silver halide emulsion layer containing a magenta dye forming coupler and a red-sensitive silver halide emulsion layer containing a cyan dye forming coupler, wherein spectral reflection absorption characteristics of a yellow dye, a magenta dye and a cyan dye which are formed of the yellow dye forming coupler, the magenta dye forming coupler and the cyan dye forming coupler, respectively, meet the following requirements:

$$108 \geqq \lambda max(M) - \lambda max(Y) \geqq 100,$$

$$80 \geqq \lambda max(C) - \lambda max(M) \geqq 70,$$

$$0.42 \geqq Abs_{600}(M) \geqq 0.40,$$

and $$0.46 \geqq Abs_{550}(C) \geqq 0.35,$$

wherein λmax(Y) is a wavelength at an absorption maximum of the formed yellow dye, λmax(M) is a wavelength at an absorption maximum of the formed magenta dye and λmax(C) is a wavelength at an absorption maximum of the formed cyan dye; $Abs_{600}$ (M) is an absorbance at a wavelength of 600 nm of the magenta dye having 1.0 of an absorbance at the absorption maximum and $Abs_{550}$ (C) is an absorbance at a wavelength of 550 nm of the cyan dye having 1.0 of an absorbance at the absorption maximum.

Thus, in the invention, a method for enhancing conflicting performances such as expanded color gamut and minimized dependency on light sources was achieved by greatly reducing the difference in wavelength at an absorption maximum between magenta and cyan dyes [i.e., λmax(M) and λmax (C)], which had been considered to cause failure in color and by specifying spectral absorptions of the magenta and cyan dyes within a narrow range.

Furthermore, preferred embodiments of the invention are as follows:

(5) The silver halide photographic material described in (3) or (4), wherein the magenta coupler is represented by the following formula (M-I) and the green-sensitive layer further containing a compound represented by the following formula (S-I) in an amount of 30 to 150% by weight, based on a total of magenta coupler(s) contained in the green-sensitive layer; the cyan coupler is represented by the following formula (C-I) and the red-sensitive layer further containing a compound represented by the following formula (S-II) in an amount of 30 to 150% by weight, based on a total of cyan coupler(s) contained in the red-sensitive layer:

formula (M-I)

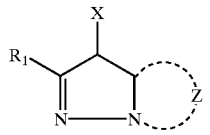

wherein $R_1$ is a hydrogen atom or a substituent group; X is a hydrogen atom or a group capable of being released from the coupler upon coupling reaction with an oxidation product of a color developing agent (also denoted as a coupling-off group); and Z is a non-metallic atom group necessary to form a nitrogen-containing heterocyclic ring, which may be substituted by at least one substituent group;

$R_2$—OH formula (S-I)

wherein $R_2$ is a substituent group having 11 to 30 carbons including at least one unsaturated carbon;

formula (C-I)

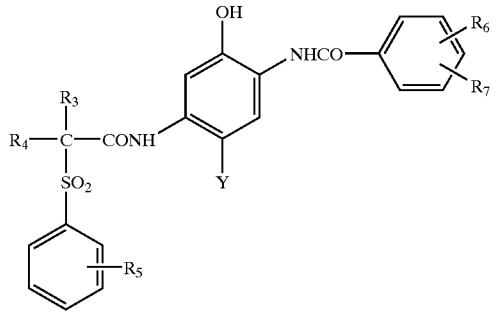

wherein $R_3$ and $R_4$ are each a hydrogen atom or an alkyl group; $R_5$, $R_6$ and $R_7$ are each a hydrogen atom, an alkyl group, an alkoxy group or a halogen atom; Y is a hydrogen atom or a group capable of being released from the coupler upon reaction with an oxidation product of a color developing agent;

formula (S-II)

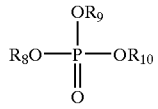

wherein $R_8$, $R_9$ and $R_{10}$ are each an alkyl group having 6 to 20 carbons;

(6) The silver halide photographic material described in (3) or (4), wherein the magenta coupler is represented by the foregoing formula (M-I) and the green-sensitive layer further containing a compound represented by the foregoing formula (S-I) in an amount of 30 to 150% by weight, based on a total of magenta coupler(s) contained in the green-sensitive layer; the cyan coupler is represented by the foregoing formula (C-I) and the red-sensitive layer further containing a compound represented by the foregoing formula (S-II) in an amount of 30 to 150% by weight, based on a total of cyan coupler(s) contained in the red-sensitive layer; and the yellow coupler is represented by the following formula (Y-I):

formula (Y-I)

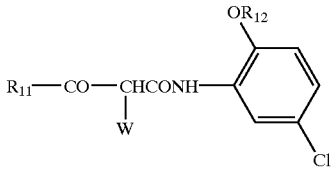

wherein $R_{11}$, is an aliphatic group or an aromaticl group; W is a 5- or 6-membered nitrogen-containing heterocyclic group capable of being released from the coupler upon reaction with an oxidation product of a color developing agent; and $R_{12}$ is a ballasted aliphatic group of a ballasted aromatic group;

(7) The silver halide photographic material described in (6), wherein the magenta coupler is represented by the following formula (M-Ia) and the cyan coupler being represented by the following formula (C-Ia):

formula (M-Ia)

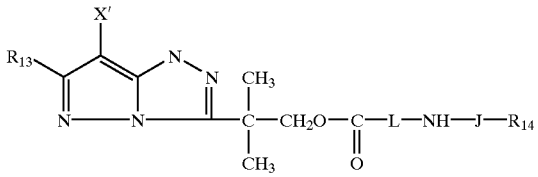

wherein $R_{13}$ is a hydrogen atom or a substituent group; $R_{14}$ is a hydrogen atom or an alkyl group, a cycloalkyl group or an aryl group, each which may be substituted by at least one substituent group; X' is a hydrogen atom or a group capable of being released from the coupler upon coupling reaction with an oxidation product of a color developing agent; L is an alkylene group; and J is —CO— or —$SO_2$—;

formula (C-Ia)

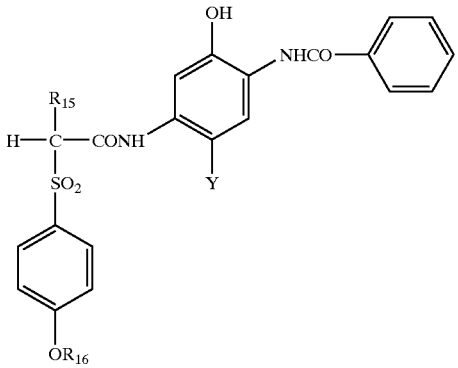

wherein $R_{15}$ is a hydrogen atom or an alkyl group; $R_{16}$ is an alkyl group having 10 to 20 carbon atoms; and Y is a hydrogen atom or a group capable of being released from the coupler upon reaction with an oxidation product of a color developing agent;

(8) The silver halide photographic material described in (7), wherein the green-sensitive layer further contains a compound represented by formula (U-I) in an amount of 20 to 100% by weight, based on a total of magenta coupler(s) contained in the green-sensitive layer:

formula (U-I)

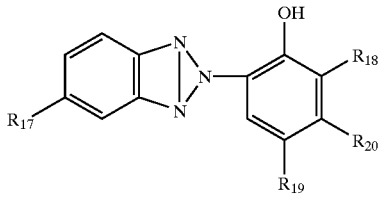

wherein $R_{17}$, $R_{18}$ and $R_{19}$ are each a hydrogen atom, a halogen atom, an alkyl group, an alkoxy group or an aryl group; $R_{20}$ is a hydrogen atom, an alkyl group, an alkoxy group, an aryloxy group, an acylamino group, a sulfonamido group or a ureido group;

(9) The silver halide photographic material described in (8), wherein the red-sensitive layer further contains a compound represented by the foregoing formula (U-I) in an amount of 20 to 100% by weight, based on a total of cyan coupler(s) contained in the red-sensitive layer.

DETAILED DESCRIPTION OF THE INVENTION

The yellow dyes, magenta dye and cyan dye used in the invention are dyes which have a spectral absorption maximum at the wavelength of 400 to 500 nm, 500 to 600 nm and 600 to 750 nm, respectively. The yellow dye, magenta dye and cyan dye may be comprised of a single dye or a mixture of two or more dyes.

Determination of the photographic element, transmission-type silver halide photographic material and reflection-type silver halide photographic material relating to the invention will be described. A photographic element comprising a yellow dye forming coupler, a magenta dye forming coupler and a cyan dye forming coupler; a silver halide photographic material comprising a transmission support, a yellow dye forming coupler, a magenta dye forming coupler and a cyan dye forming coupler; or a silver halide photographic material comprising a reflection support, a yellow dye forming coupler, a magenta dye forming coupler and a cyan dye forming coupler are each exposed to blue light through an optical wedge in accordance with the conventional manner and then processed with a p-phenylenediamine color developer solution to obtain a color print having a yellow wedge-wise image. A portion having 1.0 of an absorbance at the absorption maximum (λmax) in the obtained color print is measured with respect to spectral reflection absorption, using Color Analyzer Type 607, available from Hitachi, Ltd. From the obtained reflection absorption spectrum, the wavelength at the absorption maximum, λmax(Y) is determined. Similarly, exposure to green or red light and processing are conducted and from the obtained spectral absorption, λmax (M), λmax(C), $Abs_{600}$(M) and $Abs_{550}$(C) are determined. The photographic element, and reflection-type or transmission-type photographic material according to the invention meet the requirement of "λmax(M)−λmax(Y)" being not less than 95 and not more than 110, "λmax(C)−λmax(M)" being not less than 70 and not more than 80, $Abs_{600}$ (M) being not less than 0.38 and not more than 0.43, and $Abs_{550}$ (C) being not less than 0.35 and not more than 0.48; and preferably "λmax(M)−λmax(Y)" being not less than 95 and not more than 110, "λmax(C)−λmax(M)" being not less than 70 and not more than 80, $Abs_{600}$ (M) being not less than 0.40 and not more than 0.42, and $Abs_{550}$ (C) being not less than 0.35 and not more than 0.46.

The silver halide photographic material according to the invention is a reflection-type or transmission-type silver halide photographic material, which comprises on a reflection or transmission support at least three silver halide emulsion layer and further comprises the photographic element of the invention.

Yellow couplers used in the invention include benzoylacetoanilide-type and pivaloylacetoanilide-type couplers, as described, for example, in JP-A No. 2000-147725. Specifically, yellow couplers usable in the invention are compounds represented by the following formula (Y-I):

formula (Y-I)

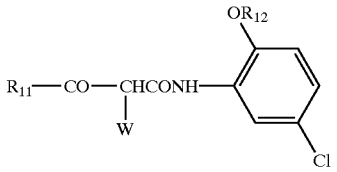

wherein $R_{11}$ is an aliphatic group or an aromatic group; W is a 5- or 6-membered nitrogen-containing heterocyclic group capable of being released from the coupler upon reaction with an oxidation product of a color developing agent; and $R_{12}$ is a ballasted aliphatic or aromatic group.

In the formula (I), the aliphatic group represented by $R_{11}$ preferably is a straight-chain, branched or cyclic alkyl group, such as methyl, ethyl, isopropyl, t-butyl, adamantly, and n-dodecyl, 1-hexylnonyl. The alkyl group represented by $R_1$ may be substituted. Examples of substituents include a halogen atom (e.g., chlorine, bromine), an aryl group (e.g., phenyl, p-t-octylphenyl), an alkoxy group (e.g., methoxy), aryloxy (e.g., 2,4-di-t-amylphenoxy), sulfonyl group (e.g., methanesulfonyl), acylamino group (e.g., acetylamino, benzoylamino), sulfonylamino (e.g., n-dodecanesulfonyl) and hydroxy group. The aromatic group represented by $R_{11}$ preferably is an aryl group having 6 to 14 carbon atoms, such as phenyl, 1-naphthyl, and 9-anthranyl. The aryl group may be substituted. Example of substituents include nitro, cyano, amino (e.g., dimethylamino, anilino), alkylthio, alkyl (as cited in the foregoing alkyl group defined by $R_{11}$) and substituents (as cited in the foregoing alkyl group defined by $R_{11}$). Further, $R_{11}$ is more preferably an alkyl group, still more preferably branched alkyl group, and t-butyl is specifically preferred.

The ballasted aliphatic group represented by $R_{12}$ is preferably a straight chain, branched or cyclic alkyl group having 8 to 21 carbon atoms, such as 2,6-dimethylcyclohexyl, 2-ethylhexyl, isotridecyl, hexadecyl, and octadecyl. The ballasted alkyl group may be via a linking group, as represented by the following formula:

$$—J—X—R'_{12}$$

wherein J is a straight-chain or branched alkylene group having 1 to 20 carbon atoms, such as methylene, 1,2-ethylene, 1,1-dimethylmethylene and 1-decylmethylene; $R'_{12}$ is a straight-chain or branched alkyl group having 1 to 20 carbon atoms, as cited in the foregoing aliphatic group represented by $R_{11}$; X is a linking group, such as —O—, —OCO—,—$OSO_2$—, —CO—, —COO—, —CON($R_{13}$)—, —CON($R_{13}$)$SO_2$—, —N($R_{13}$)—, —N($R_{13}$)CO—, —N($R_{13}$)$SO_2$—, —N($R_{13}$)CON($R_{14}$)—, —N($R_{13}$)COO—, —S(O)$_n$—, —S(O)$_n$N($R_{13}$)—, and —S(O)$_n$N($R_{13}$)CO—, in which $R_{13}$ and $R_{14}$ are each a hydrogen atom, alkyl or aryl, as defined in the foregoing $R_{11}$, and n is 0, 1 or 2. Further, $R'_{12}$ and J may combine with each other to form a ring. The alkyl group represented by $R_{12}$ may be substituted. Examples of substituents are the same as cited in the foregoing $R_{11}$. The ballasted aromatic group represented by $R_{12}$ is preferably an aryl group, which is the same as defined in the foregoing $R_{11}$. The aryl group may be substituted. Examples of a substituent are the same as cited in the foregoing aryl group represented by $R_{11}$. Of these substituents is preferred a branched alkyl group having 4 to 10 carbon atoms. Further, $R_{12}$ is more preferably a ballasted aromatic group.

In the formula (Y-I), W is a 5- or 6-membered nitrogen-containing heterocyclic group capable of being released from the coupler upon reaction with an oxidation product of a color developing agent, and represented by the following formula:

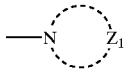

wherein $Z_1$ is a nonmetallic atom group necessary to form a 5- or 6-membered ring, together with a nitrogen atom. Examples of the nonmetallic atom group include substituted or unsubstituted methylene or methine group, ═C═O, ═N—$R_{15}$ (in which $R_{15}$ is a hydrogen atom, an alkyl, cycloalkyl, aryl, or heterocyclic group), —N═, —O—, —S(O)$_m$ (in which m is 0, 1 or 2).

Exemplary examples of the compound represented by the formula (Y-I) are shown below.

| No. | $R_{11}$ | $R_{12}$ | W |
|---|---|---|---|
| YI-1 | $(CH_3)_3C$— | —$C_{18}H_{37}$ | 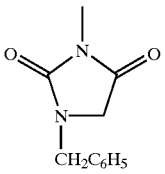 |

-continued
| No. | $R_{11}$ | $R_{12}$ | W |
|---|---|---|---|
| YI-2 | $(CH_3)_3C$— | —$C_{18}H_{37}$ | 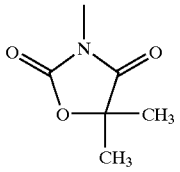 |
| YI-3 | $(CH_3)_3C$— | —$C_{16}H_{33}$ | 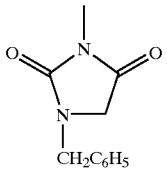 |
| YI-4 | $(CH_3)_3C$— | —$C_{16}H_{33}$ | 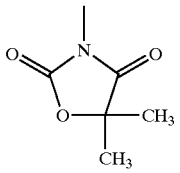 |
| YI-5 | $(CH_3)_3C$— | —$C_{14}H_{29}$ | 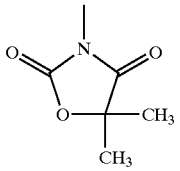 |
| YI-6 | $(CH_3)_3C$— | —$C_{14}H_{29}$ | 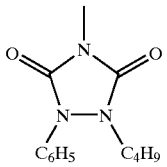 |
| YI-7 | $(CH_3)_3C$— | —$C_{14}H_{29}$ | 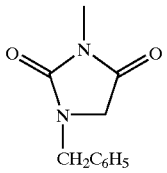 |
| YI-8 | $(CH_3)_3C$— | —$C_{12}H_{25}$ | 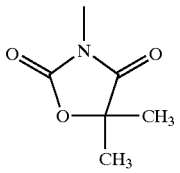 |
| YI-9 | $(CH_3)_3C$— | —$C_{12}H_{25}$ | 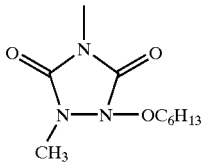 |

-continued
| No. | $R_{11}$ | $R_{12}$ | W |
|---|---|---|---|
| YI-10 | $(CH_3)_3C$— | 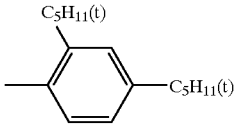 | 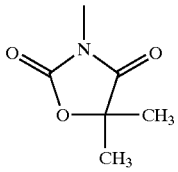 |
| YI-11 | $(CH_3)_3C$— | 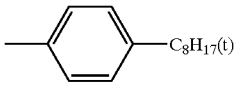 | 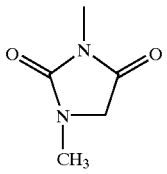 |
| YI-12 | 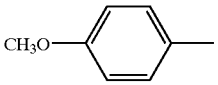 | —$C_8H_{17}$(t) | 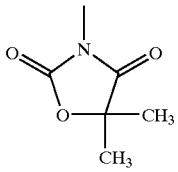 |
| YI-13 | 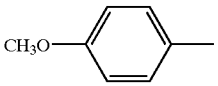 | —$C_{16}H_{33}$ | 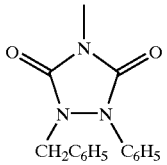 |
| YI-14 | 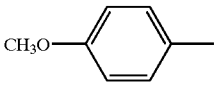 | —$CH_2CO_2C_{12}H_{25}$ | 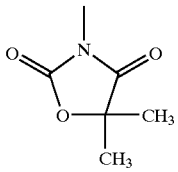 |
| YI-15 | 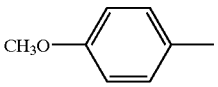 | 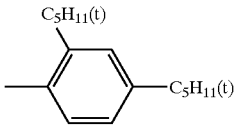 | 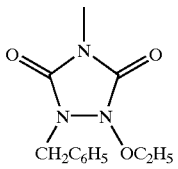 |
| YI-16 | 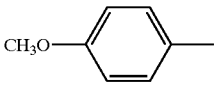 | 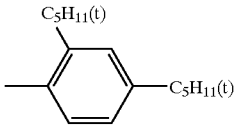 | 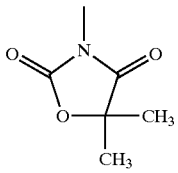 |
| YI-17 | $(CH_3)_3C$— | —$C_{12}H_{25}$ | 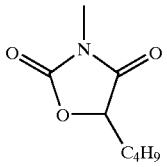 |

-continued

| No. | $R_{11}$ | $R_{12}$ | W |
|---|---|---|---|
| YI-18 | $CH_3O$ | $C_5H_{11}(t)$ / $C_5H_{11}(t)$ | N, O, O, N–N, $CH_2C_6H_5$, $C_6H_5$ |
| YI-19 | $CH_3O$ | $C_5H_{11}(t)$ / $C_5H_{11}(t)$ | N, O, O, O, $CH_3$, $CH_3$ |
| YI-20 | $CH_3O$ | $C_5H_{11}(t)$ / $C_5H_{11}(t)$ | N, O, O, N–N, $CH_2C_6H_5$, $OC_2H_5$ |
| YI-21 | $CH_3O$ | $C_8H_{17}(t)$ | N, O, O, O, $CH_3$, $CH_3$ |
| YI-22 | $CH_3O$ | $C_8H_{17}(t)$ | N, O, O, N–N, $C_6H_5$, $C_4H_9$ |
| YI-23 | $CH_3O$ | $C_{15}H_{31}$ | N, O, O, O, $CH_3$, $CH_3$ |

Magenta couplers used in the invention include, for example, pyrazolotriazole-type couplers, as described in JP-A 2000-147725, item 2. The magenta coupler usable in the invention is preferably a compound represented by the following formula (M-I):

formula (M-I)

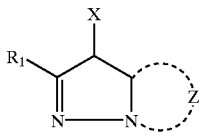

wherein $R_1$ is a hydrogen atom or a substituent; X is a hydrogen atom or a group capable of being released from the coupler upon coupling reaction with an oxidation product of a color developing agent; and Z is a non-metallic atom group necessary to form a nitrogen-containing heterocyclic ring, which may be substituted by at least one substituent group.

Representative examples of the substituent represented by $R_1$ include an alkyl, aryl group, anilino group, acylamino and sulfonamido group, alkylthio group, arylthio group, alkenyl group and cycloalkyl group. Further are also included a halogen atom, a cycloalkenyl group, alkynyl group, heterocyclic group, sulfonyl group, sulfinyl group, phosphonyl group, acyl group, carbamoyl group, sulfamoyl group, cyano group, alkoxy group, aryloxy group, heterocyclioxy group, siloxy group, acyloxy group, carbamoyloxy group, amino group, alkylamino group, imido group, ureido group, sulfamoylamino group, alkoxycarbonyl group, arylcarbonyl group, heterocycli-thio group, spiro-compound residue and bridged hydrocarbon compound residue.

Furthermore, the magenta coupler usable in the invention is represented by the following formula (M-Ia):

formula (M-Ia)

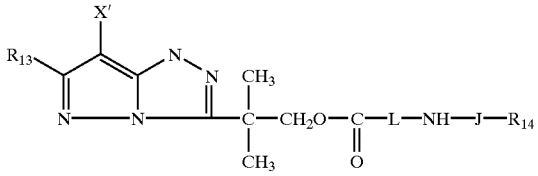

wherein $R_{13}$ is a hydrogen atom or a substituent; $R_{14}$ is a hydrogen atom or an alkyl group, a cycloalkyl group or an aryl group, each which may be substituted by at least one substituent group; X' is a hydrogen atom or a group capable of being released from the coupler upon coupling reaction with an oxidation product of a color developing agent; L is an alkylene group, which may be substituted; and J is —CO— or —$SO_2$—.

Examples of the substituent represented by $R_{13}$ include an alkyl group (e.g., methyl, ethyl, propyl, I-propyl, t-butyl, pentyl, cyclopentyl, hexyl, cyclohexyl, octyl, dodecyl), alkenyl group (e.g., vinyl, allyl), alkynyl group (e.g.,propargyl), aryl group (e.g., phenyl, naphthyl), heterocyclic group (e.g., pyridyl, thiazolyl, oxazolyl, imidazolyl, furyl, pyrrolyl, pyrazyl, pyrimidyl, pyridazinyl, selenazolyl, sulforanyl, piperidinyl, pyrazolyl, tetrazolyl), halogen atom (e.g., fluorine, chlorine, bromine, iodine), alkoxy group (e.g., methoxy, ethoxy, propyloxy, pentyloxy, cyclopentyloxy, hexyloxy, cyclohexyloxy, octyloxy, dodecyloxy), aryloxy group (e.g., phenoxy, naphthyloxy), alkoxycarbonyl group (e.g., methoxycarbonyl, ethoxycarbonyl, butoxycarbonyl, octyloxycarbonyl, dodecyloxycarbonyl), aryloxycarbonyl group (e.g., phenoxycarbonyl, naphthoxycarbonyl), sulfonamido group (e.g., methylsulfonylamino, ethylsulfonylamino, butylsulfonylamino, hexylsulfonylamino, cyclohexylsulfonylamino, ocylsulfonylamino, dodecylsulfonylamino, phenylsulfonylamino), sulfamoyl group (e.g., aminosulfonyl, methylaminosulfonyl, dimethylaminosulfonyl, butylaminosulfonyl, hexylaminosulfonyl, cyclohexylaminosulfonyl, octylaminosulfonyl, dodecylaminosulfonyl, phenylaminosulfonyl, naphthylaminosulfonyl, 2-pyridylaminosulfonyl), ureido group (e.g., methylureido, ethylureido, pentylureido, cyclohexylureido, octylureido, dodecylureido, phenylureido, naphtylureido, 2-pyridylureido), acyl group (e.g., acetyl, ethylcarbonyl, propylcarbonyl, pentylcarbonyl, cyclohexylcarbonyl, octylcarbonyl, 2-ethylhexylcarbonyl, dodecylcarbonyl, benzoyl, naphthylcarbonyl, pyridylcarbonyl), acyloxy group (e.g., acetyloxy, ethylcarbonyloxy, butylcarbonyloxy, octylcarbonyloxy, dodexylcarbonyloxy, benzoyloxy), carbamoyl group (e.g., carbamoyl, methylcarbamoyl, dimethylcarbamoyl, propylcarbamoyl, pentylcarbamoyl, cyclohexylcarbamoyl, octylcarbamoyl, 2-ethylhexylcarbamoyl, dodecylcarbamoyl, phenylcarbamoyl, phenylcarbamoyl, naphthylcarbamoyl, 2-pyridylcarbamoyl), acylamino group (e.g., methylaminocarbonyl, ethylcarbonylamino, propylaminocarbonyl, pentylcarbonylamino, cyclohexylcarbonylamino, 2-ethylhexylcarbonylamino, octylcarbonylamino, dodecylcarbonylamino, phenylcarbonylamino, naphthylcarbonylamino), sulfonyl group (e.g., methylsufonyl, ethylsulfinyl, butylsulfonyl, cyclohexylsulfonyl, 2-ethylhexylsulfonyl, dodecylsulfonyl, phenylsulfinyl, naphthylsulfonyl, 2-pyridylsulfonyl), amino group (e.g., amino, ethylamino, dimethylamino, butylamino, cyclopentylamino, 2-ethylhexylamino, dodecylamino, anilino, naphthylamino, 2-pyridylamino), cyano group, nitro group, sulfo group, carboxyl group and hydroxy group. These substituents may further be substituted by a substituent, as described above. Of these, $R_{13}$ is preferably an alkyl group, alkenyl group, aryl group, acylamino group, sulfonamido group, halogen atom, heterocyclic group, sulfonyl group, acyl group, carbamoyl group, sulfamoyl group, cyano group, alkoxy group, aryloxy group, amino group, alkylamino group, ureido group, alkoxycarbonyl group, or aryloxycarbonyl group; more preferably an alkyl group; and still more preferably t-butyl.

The alkyl group represented by $R_{14}$ is preferably an alkyl group having 1 to 32 carbon atoms, such as methyl, ethyl, propyl, I-propyl, t-butyl, hexyl, ocyl, dodecyl, hexadecyl, and 2-ethylhexyl. The alkyl group may be substituted by substituents, as defined in the foregoing $R_{13}$. The cycloalkyl group represented by $R_{14}$ is preferably a cycloalkyl group having 3 to 12 carbon atoms, such as cyclopropyl, cyclopentyl, cyclohexyl, 2-methylcyclopropyl, and adamantly. The cycloalkyl group may be substituted by substituents, as defined in the foregoing $R_{13}$. The aryl group represented by $R_{14}$ is preferably an aryl group having 6 to 14 carbon atoms. The aryl group may be substituted by substituents, as defined in the foregoing $R_{13}$.

Examples of the group capable of being released from the coupler upon coupling reaction with an oxidation product of a color developing agent, as represented by X' include an alkoxy group (e.g., methoxy, ethoxy, propyloxy, pentyloxy, cyclopentyloxy, hexyloxy, cyclohexyloxy, octyloxy, dodecyloxy), aryl group (e.g., phenoxy, naphthoxy), heterocyclic-oxy group (e.g., pyridyloxy, thiazolyloxy, oxazolyloxy, imidazolyloxy, furyloxy, pyrrolyloxy, pyrazinyloxy, pyrimidinyloxy, pyridazinyloxy, selenazolyloxy, sulfolanyloxy, piperidynyl, pyrazolyloxy, tetrazolyloxy), acyloxy group (e.g., acetyloxy, ethylcarbonyloxy, butylcarbonyloxy, octylcarbonyloxy, dodecycarbonyloxy, phenylcarbonyloxy), sufonyloxy group, alkoxycarbonyloxy group (e.g., methoxycarbonyloxy, ethoxycarbonyloxy), aryloxycarbonyloxy group (e.g., phenyloxycarbonyloxy), alkyloxazalyloxy group, alkoxyoxalyloxy group, alkylthio group (e.g., methylthio, ethylthio), arylthio group (e.g., phenylthio, naphthylthio), heterocyclic-thio group (e.g., pyridylthio, furylthio), alkyloxythiocarbonylthio group, acylamino group (e.g., methylcarbonylamino, ethylcarbonylamino, propylcarbonylamino, pentylcarbonylamino, cyclohexylcarbonylamino, 2-ethylhexylcarbonylamino, octylcarbonylamino, dodecylcarbonylamino, phenylcarbonylamino, naphthylcarbonylamino), sulfonamido group (e.g., methylsulfonylamino, ethylsulfonylamino, butylsulfonylamino, hexylsulfonylamino, cyclohexylsulfonylamino, octylsulfonylamino, dodecylsulfonylamino, phenylsulfonylamino), N-attached nitrogen-containing heterocyclic group, alkyloxycarbonylamino group, aryloxycarbonylamino group and carboxyl group. Of the foregoing groups, a halogen atom is preferred and chlorin atom is more preferred.

The alkylene group represented by L may be substituted by substituents, as defined in the foregoing $R_{13}$. Exemplary examples of the alkylene group represented by L are shown below but are not limited to these.

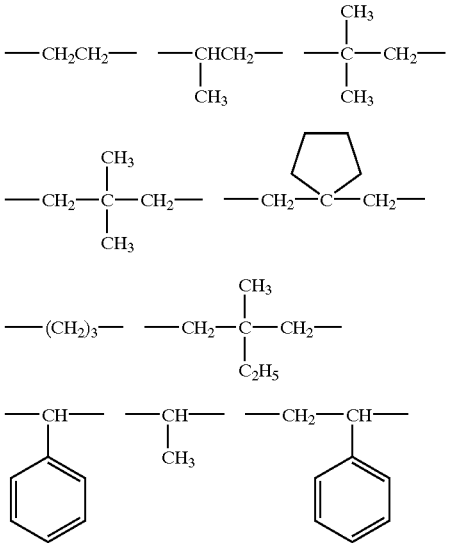
-continued
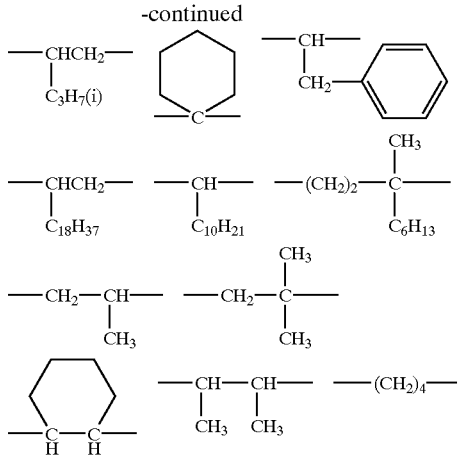
L is preferably substituted or unsubstituted ethylene, and more preferably unsubstituted ethylene.
Exemplary examples of the compound represented by the formula (M-I) or (M-Ia) are shown below but are not limited to these.
MI-1
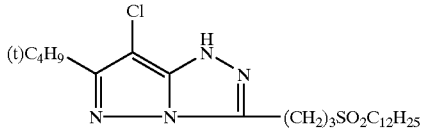
MI-2
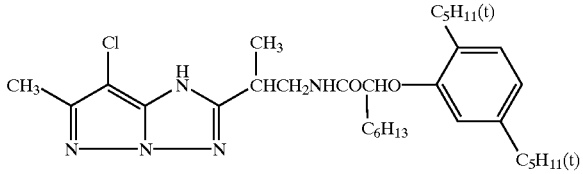
MI-3
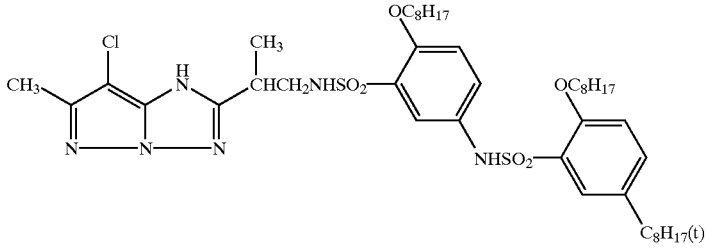
MI-4
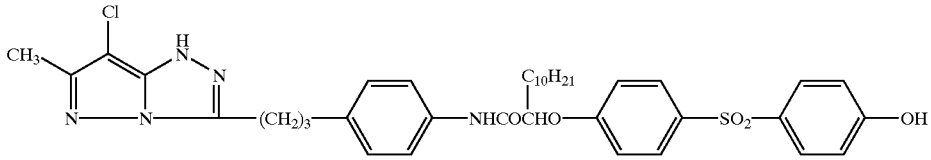
MI-5
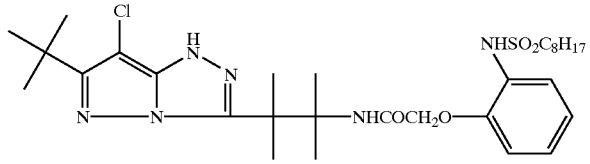

-continued
MI-6
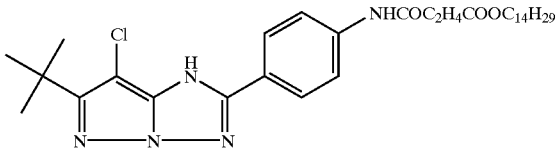
MI-7
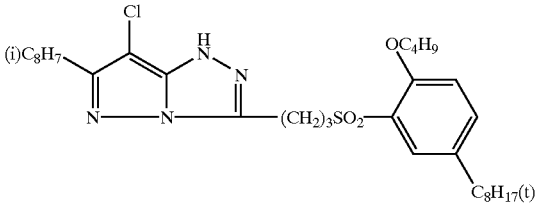
MI-8
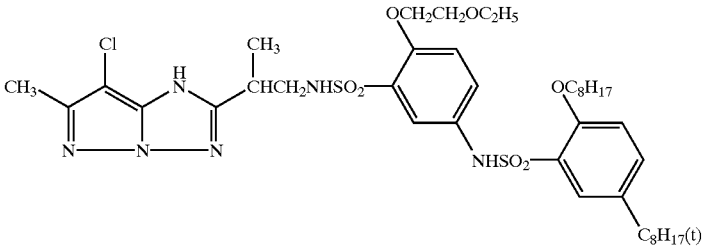
MI-a-1
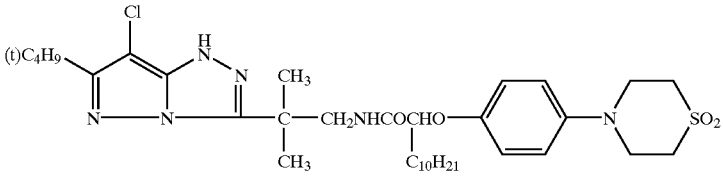
MIa-2
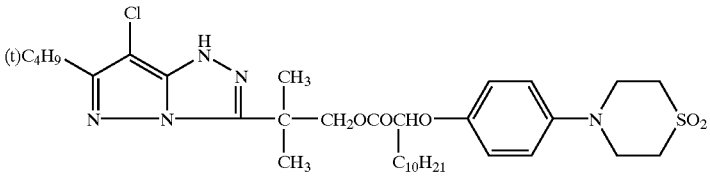
MIa-3
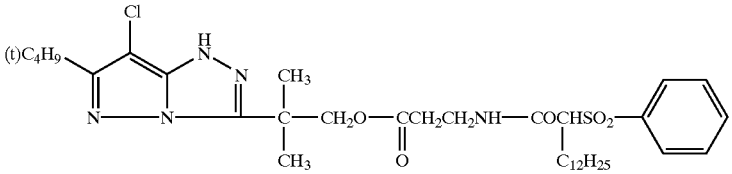
MIa-4
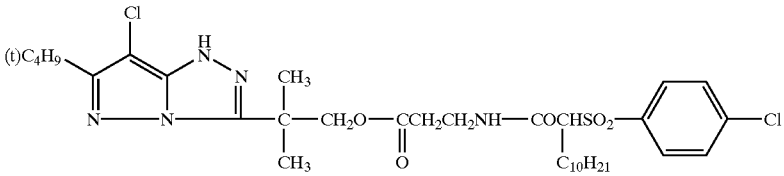
MIa-5
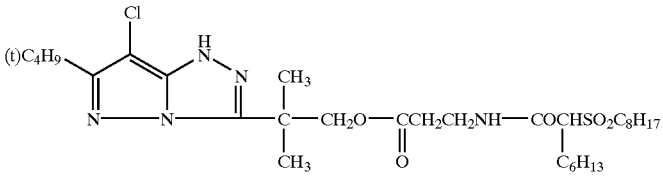

-continued
MIa-6
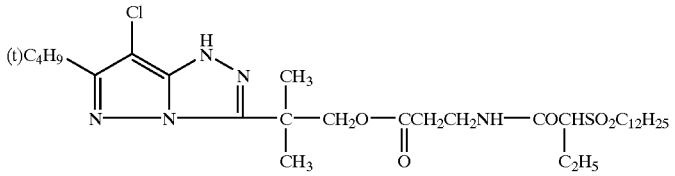
MIa-7
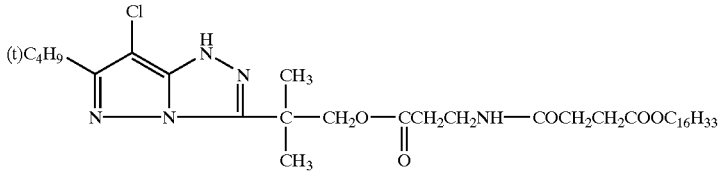
MIa-8
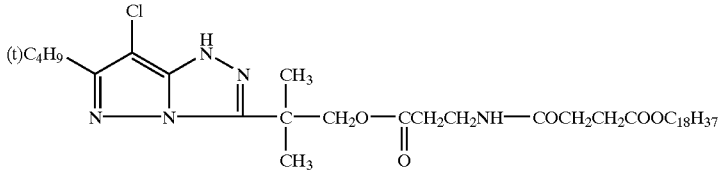
MIa-9
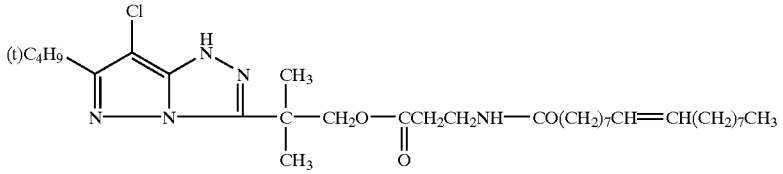
MIa-10
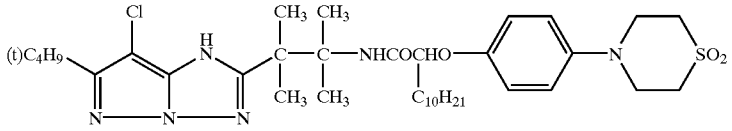
MIa-11
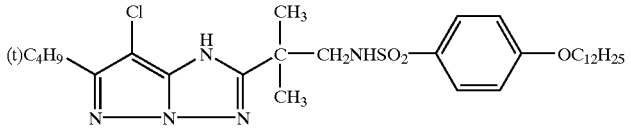
MIa-12
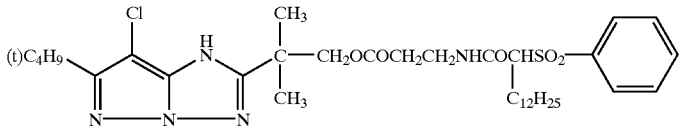

Examples of cyan couplers used in the invention include phenol-type, naphthol-type and pyrazolotriazole-type couplers. Preferred couplers are those described in JP-A 10-97039. Thus, cyan couplers usable in the invention are preferably compounds represented by the following formula (C-I):

formula (C-I)

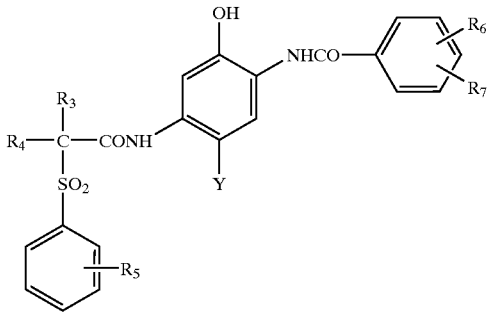

wherein $R_3$ and $R_4$ are each a hydrogen atom or an alkyl group; $R_5$, R6 and $R_7$ are each a hydrogen atom, an alkyl group, an alkoxy group or a halogen atom; Y is a hydrogen atom or a group capable of being released from the coupler upon reaction with an oxidation product of a color developing agent.

Further, more preferred cyan couplers are represented by the following formulas (C-Ia):

formula (C-Ia)

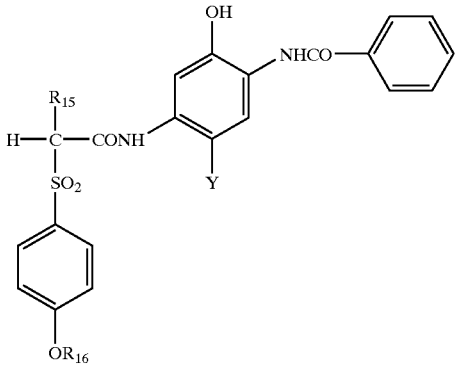

wherein $R_{15}$ is a hydrogen atom or an alkyl group; $R_{16}$ is an alkyl group having 10 to 20 carbon atoms; and Y is a hydrogen atom or a group capable of being released from the coupler upon reaction with an oxidation product of a color developing agent.

Exemplary examples of the cyan couplers represented by the formulas (C-I) and (C-Ia) are shown below but are by no means limited to these.

CI-1

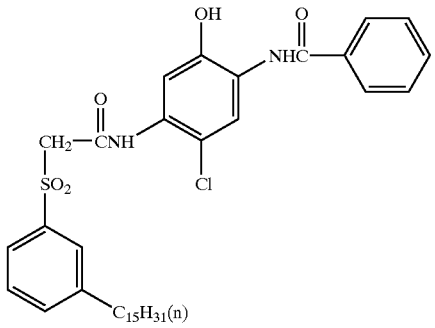

-continued

CI-2

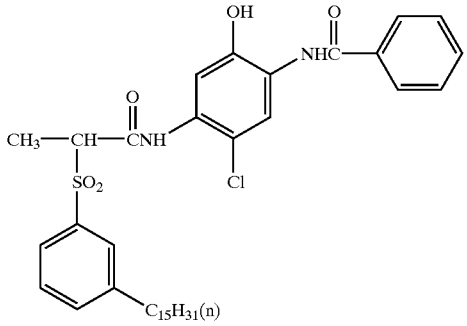

CI-3

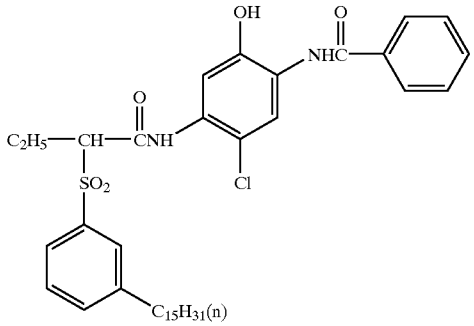

CI-4

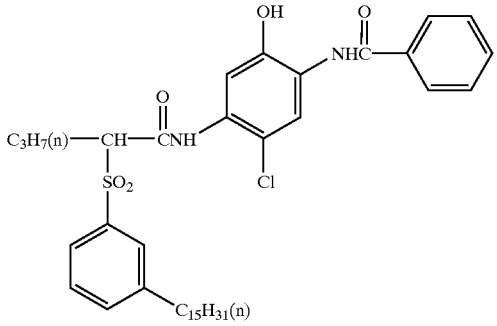

CI-5

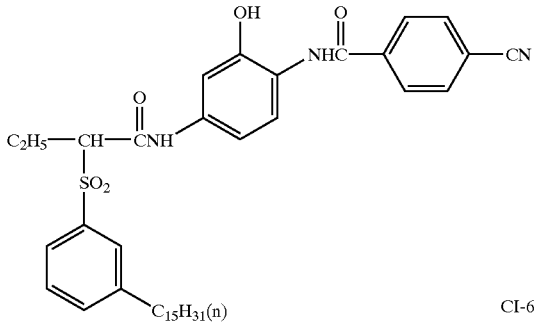

CI-6

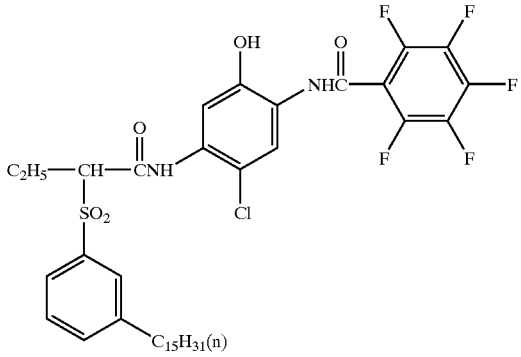

-continued
CI-7
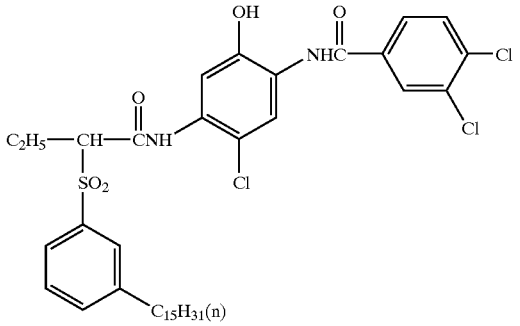
CI-8
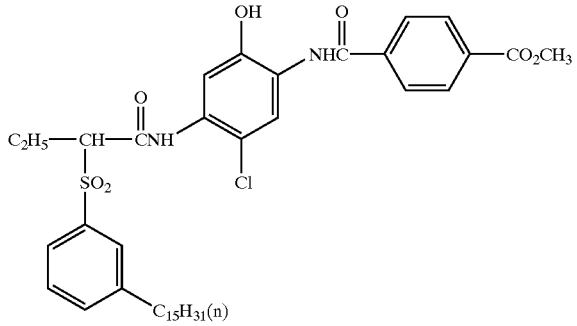
CI-9
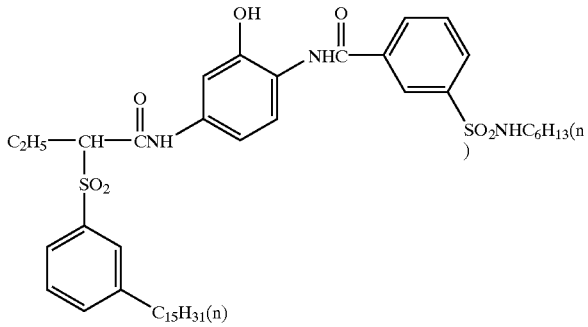
CI-10
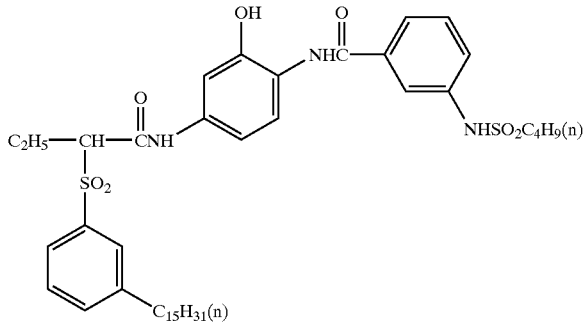
-continued
CI-11
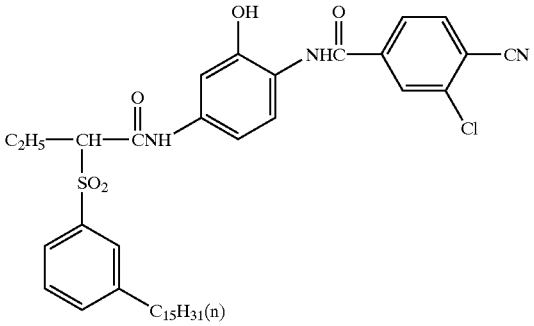
CI-12
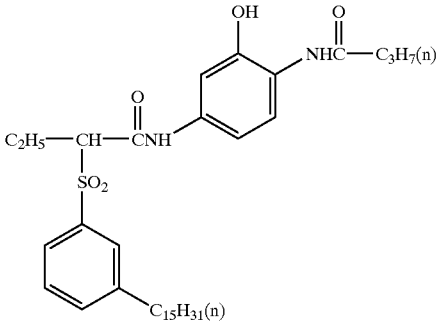
CI-13
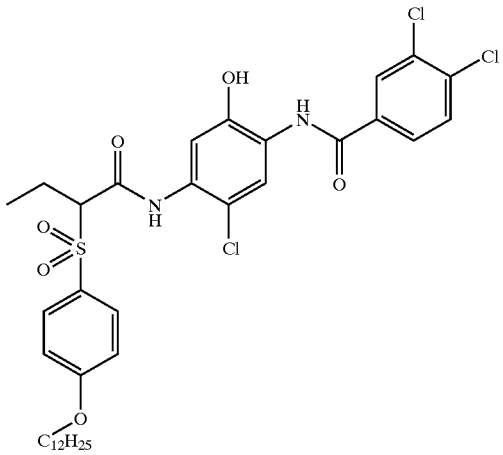
CI-14
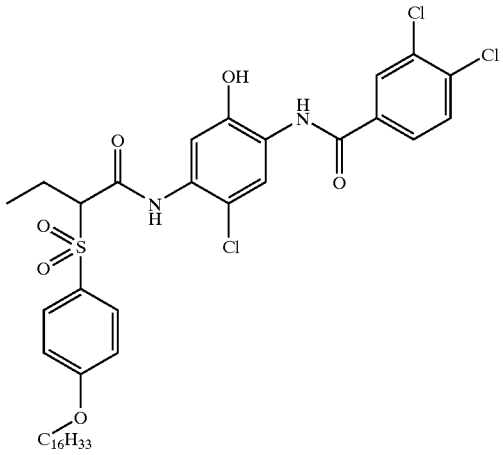

formula (c-Ia)

| | $R_{15}$ | $R_{16}$ |
|---|---|---|
| Cla-1 | $-CH_3$ | $-C_{10}H_{21}$ |
| Cla-2 | $-CH_3$ | $-C_{16}H_{33}$ |
| Cla-3 | $-CH_3$ | $-C_{18}H_{37}$ |
| Cla-4 | $-C_2H_5$ | $-C_{10}H_{21}$ |
| Cla-5 | $-C_2H_5$ | $-C_{12}H_{25}$ |
| Cla-6 | $-C_2H_5$ | $-C_{14}H_{29}$ |
| Cla-7 | $-C_2H_5$ | $-C_{16}H_{33}$ |
| Cla-8 | $-C_{10}H_{21}$ | $-C_{10}H_{21}$ |
| Cla-9 | $-C_{10}H_{21}$ | $-C_{12}H_{25}$ |

Couplers used in the invention are used through solution in high boiling solvents, including esters such as a phthalic acid ester, phosphoric acid ester and fatty acid ester, higher saturated or unsaturated alcohols, alkylphenols, organic acid amides, ketones and hydrocarbon compounds.

Specifically, compounds represented by the following formula (S-I) or (S-II) are used as a preferred high boiling solvent usable in the invention:

$R_2$—OH formula (S-I)

wherein $R_2$ is a substituent group having 11 to 30 carbons including at least one unsaturated carbon;

formula (S-II)

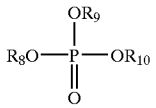

wherein $R_8$, $R_9$ and $R_{10}$ are each an alkyl group having 6 to 20 carbons.

Examples of the compound represented by formulas (S-I) and (S-II) are shown below.

formula (S-I)

SI-1

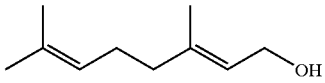

SI-2 $CH_3(CH_2)_7CH{=}CH(CH_2)_7CH_2OH$

SI-3 $CH_3(CH_2)_4CH{=}CH(CH_2)_4CH_2OH$

SII-1 $O{=}P(OC_4H_9)_3$

SII-2

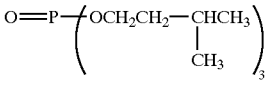

SII-3 $O{=}P(OC_6H_{13})_3$

SII-4

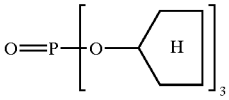

SII-5

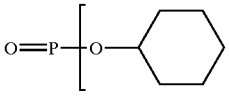

SII-6 $O{=}P(OC_8H_{17})_3$

-continued

SII-7

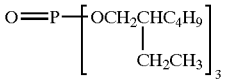

SII-8

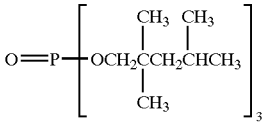

SII-9

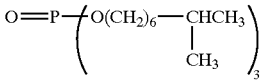

SII-10 $O{=}P(OC_9H_{19})_3$

SII-11

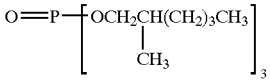

SII-12 $O{=}P(OC_{10}H_{21})_3$

SII-13

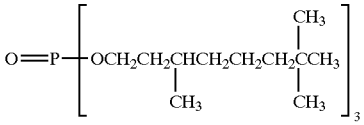

SII-14

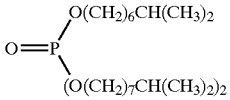

SII-15

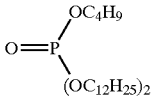

To these high boiling solvents may be incorporated various photographic additives, such as an antioxidant and UV absorbent. It is known that the spectral absorption of a dye formed of a coupler varies, depending on the kind of a high boiling solvent or photographic additive, as described in JP-A No. 11-24221. In the invention, the kind of the high boiling solvent or photographic additive can be optionally selected to adjust spectral absorption characteristics of the dye. Specifically, it is preferred to use a compound represented by the following formula (U-I) in combination with couplers used in the invention:

formula (U-I)

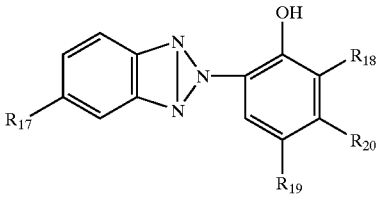

wherein $R_{17}$, $R_{18}$ and $R_{19}$ are each a hydrogen atom, a halogen atom, an alkyl group, an alkoxy group or an aryl group; $R_{20}$ is a hydrogen atom, an alkyl group, an alkoxy group, an aryloxy group, an acylamino group, a sulfonamido group or a ureido group.

Exemplary examples of the compound represented by formula (U-I) are shown below.

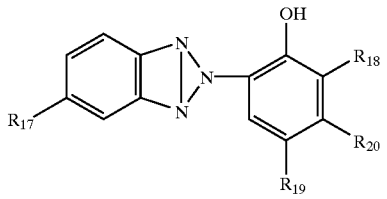

| Example No. | $R_{17}$ | $R_{18}$ | $R_{19}$ | $R_{20}$ |
|---|---|---|---|---|
| UI-1 | H | H | H | H |
| UI-2 | H | H | —$CH_3$ | H |
| UI-3 | H | H | —$C_4H_9$(t) | H |
| UI-4 | H | —$C_4H_9$(t) | —$C_4H_9$(t) | H |
| UI-5 | Cl | —$C_4H_9$(t) | —$CH_3$ | H |
| UI-6 | Cl | —$C_4H_9$(t) | —$C_4H_9$(t) | H |
| UI-7 | H | —$C_5H_{11}$(t) | —$C_5H_{11}$(t) | H |
| UI-8 | —$C_4H_9$(t) | —$C_4H_9$(t) | —$C_4H_9$(t) | H |
| UI-9 | —$C_4H_9$(t) | —$C_4H_9$(t) | —$C_4H_9$(t) | H |
| UI-10 | —$C_5H_{11}$(t) | —$C_5H_{11}$(t) | —$C_5H_{11}$(t) | H |
| UI-11 | H | H | —$C_8H_{17}$(t) | H |
| UI-12 | H | —$C_4H_9$(t) | —$C_4H_9$(t) | H |
| UI-13 | H | —$CH_3$ | —$C_4H_9$(sec) | H |
| UI-14 | —$OCH_3$ | —$C_5H_{11}$(t) | —$C_5H_{11}$(t) | H |
| UI-15 | —$CH_3$ | —$CH_5H_{11}$(t) | —O— 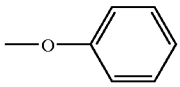 | H |
| UI-16 | H | H | —$C_{12}H_{25}$(t) | H |
| UI-17 | —$OCH_3$ | H | —$OC_8H_{17}$(sec) | H |
| UI-18 | —$C_4H_9$ | —$C_4H_9$(sec) | —$C_4H_9$(t) | H |
| UI-19 | —$C_4H_9$(t) | —$C_4H_9$(sec) | —$C_5H_{11}$(t) | H |
| UI-20 | —$C_4H_9$(sec) | —$C_4H_9$(t) | —$C_4H_9$(t) | H |
| UI-21 | H | —$C_4H_9$(t) | —$(CH_2)_2CO_2C_8H_{17}$ | H |
| UI-22 | H | —$C_8H_{17}$(t) | —$CH_3$ | H |
| UI-23 | H | —$C_{12}H_{25}$ | —$CH_3$ | H |
| UI-24 | Cl | —$C_4H_9$(t) | —$(CH_2)_2CO_2C_8H_{17}$ | H |
| UI-25 | H | —$C_4H_9$(t) | —$(CH_2)_2CO_2C_8H_{17}$ | H |
| UI-26 | H | —$C_4H_9$(sec) | —$C_4H_9$(t) | H |
| UI-27 | H | —$C_{12}H_{25}$(i) | H | H |
| UI-28 | H | H | H | —$OCH_2CH(C_2H_5)C_4H_9$ |
| UI-29 | Cl | H | H | —$NHCO_2CH_2CH(C_2H_5)C_4H_9$ |

Silver halide emulsions used in the invention can be prepared by the methods known in the art. Reflection supports used in the invention may be any material, including, for example, paper coated with polyethylene (PE) or polyethylene terephthalate, a paper support comprised of natural pulp or synthetic pulp, polyvinyl chloride sheet, polypropylene containing a white pigment, PET support and baryta paper. Of these is preferred a support having water-proof resin coat on both sides of base paper. The water-proof resin is preferably PE, PET or copolymers thereof.

Transmission supports used in the invention may be any material, including, for example, homopolymers such as polyesters (e.g., polyethylene terephthalate), polyvinyl alcohol, polyvinyl chloride, fluorovinyl resin and polyvinyl acetate and their copolymers; homopolymers such as cellulose acetate, polyacrylonitrile, poly(alkyl acrylate), poly (alkyl methacrylate), polymethacrylate, poly(alkyl vinyl ester), poly(alkyl vinyl ether) and polyamide, and their copolymers. Of these, polyesters are preferred. The polyesters include not only thermoplastic resins comprised of a polyester alone but also those which contain other polymers or addenda within the range of causing no variation in practical characteristics of the polyester resin as a main component.

The present invention are applied preferably to photographic materials forming images for direct appreciation, and examples thereof include color paper, color reversal paper, positive image forming photographic material, photographic material for use in display and photographic material for use in color proof.

EXAMPLES

The present invention will be described based on examples but embodiments of the invention are by no means limited to these.

Example 1

There was prepared a paper support laminated, on paper with a weight of 180 g/$m^2$, with high density polyethylene, provided that the side to be coated with an emulsion layer was laminated with polyethylene melt containing surface-treated anatase type titanium oxide in an amount of 15% by weight. The reflection support was subjected to corona discharge and provided with a gelatin sublayer, and further thereon, the following component layers were provided to prepare a silver halide photographic material.

1st Layer Coating Solution

To 15.03 g of yellow coupler (Y-1), 1.67 g of dye image stabilizer (ST-1), 1.67 g of dye image stabilizer (ST-2), 3.34 g of dye image stabilizer (ST-5), 0.167 g of antistaining agent (HQ-1), 2.67 g of image stabilizer A, 1.34 g of image stabilizer B, 5.0 g of high boiling organic solvent (DBP) and 1.67 g of high boiling solvent (DNP) was added 60 ml of ethyl acetate. Using a ultrasonic homogenizer, the resulting solution was dispersed in 320 ml of an aqueous 7% gelatin solution containing 5 ml of an aqueous 10% surfactant (SU-1) solution to obtain 500 ml of a yellow coupler dispersion. The obtained dispersion was mixed with the blue-sensitive silver halide emulsion (Em-B) described later to prepare a 1st layer coating solution.

2nd Layer to 7th Layer Coating Solution

Coating solutions for the 2nd layer to 7th layer were each prepared similarly to the 1st layer coating solution, and each coating solution was coated so as to have a coating amount as shown Tables 1 and 2. Hardeners (H-1) and (H-2) were incorporated. There were also incorporated surfactants, (SU-2) and (SU-3) to adjust surface tension. Antiseptic F-1 was further incorporated in a total amount of 0.04 g/m$^2$.

| Layer | Constitution | Amount (g/m$^2$) |
|---|---|---|
| 7th Layer (Protective layer) | Gelatin | 0.70 |
| | DIDP | 0.002 |
| | DBP | 0.002 |
| | Silicon dioxide | 0.003 |
| 6th Layer (UV absorbing layer) | Gelatin | 0.40 |
| | AI-1 | 0.01 |
| | UV absorbent (UI-7) | 0.07 |
| | UV absorbent (UI-23) | 0.12 |
| | Antistaining agent (HQ-5) | 0.02 |
| 5th Layer (Red-sensitive layer) | Gelatin | 1.00 |
| | Red-sensitive emulsion (Em-R) | 0.17 |
| | Cyan coupler (C-1) | 0.22 |
| | Cyan coupler (C-2) | 0.06 |
| | Dye image stabilizer (ST-1) | 0.06 |
| | Antistaining agent (HQ-1) | 0.003 |
| | DBP | 0.10 |
| | TCP | 0.20 |
| 4th Layer (UV absorbing layer) | Gelatin | 0.94 |
| | UV absorbent (UV-7) | 0.66 |
| | UV absorbent (UI-23) | 0.09 |
| | AI-1 | 0.02 |
| | Antistaining agent (HQ-5) | 0.10 |
| 3rd Layer (Green-sensitive layer) | Gelatin | 1.30 |
| | AI-2 | 0.01 |
| | Green-sensitive Emulsion (Em-G) | 0.12 |
| | Magenta coupler (MI-1) | 0.05 |

-continued

| Layer | Constitution | Amount (g/m$^2$) |
|---|---|---|
| | Magenta coupler (MIa-3) | 0.15 |
| | Dye image stabilizer (ST-3) | 0.10 |
| | Dye image stabilizer (ST-4) | 0.02 |
| | DIDP | 0.10 |
| | DBP | 0.10 |
| 2nd layer (Interlayer) | Gelatin | 1.20 |
| | AI-3 | 0.01 |
| | Antistaining agent (HQ-1) | 0.02 |
| | Antistaining agent (HQ-2) | 0.03 |
| | Antistaining agent (HQ-3) | 0.06 |
| | Antistaining agent (HQ-4) | 0.03 |
| | Antistaining agent (HQ-5) | 0.03 |
| | DIDP | 0.04 |
| | DBP | 0.02 |
| 1st layer (Blue-sensitive layer) | Gelatin | 1.10 |
| | Blue-sensitive Emulsion (Em-B) | 0.24 |
| | Yellow coupler (Y-1) | 0.45 |
| | Dye image stabilizer (ST-1) | 0.05 |
| | Dye image stabilizer (ST-2) | 0.05 |
| | Dye image stabilizer (ST-5) | 0.10 |
| | Antistaining agent (HQ-1) | 0.005 |
| | Image stabilizer A | 0.08 |
| | Image stabilizer B | 0.04 |
| | DNP | 0.05 |
| | DBP | 0.15 |
| Support | Polyethylene-laminated paper containing a slight amount of colorant | |

The amount of silver halide was represented by equivalent converted to silver.

SU-1: Sodium tri-i-propylnaphthalenesulfonate

SU-2: Di(2-ethylhexyl) sulfosuccinate sodium salt

SU-3: 2,2,3,3,4,4,5,5-Octafluoropentyl sulfosuccinate sodium salt

DBP: Dibutyl phthalate

DNP: Dinonyl phthalate

TCP: Tricresyl phospage

DIDP: Diisodecyl phthalate

H-1: Tetrakis(vinylsulfonylmethyl)methane

H-2: 2,4-Dichloro-6-hydroxy-s-triazine sodium salt

HQ-1: 2,5-Di-t-octylhydroquinone

HQ-2: 2,5-Di-sec-dodecylhydroquinone

HQ-3: 2,5-Di-sec-tetradecylhydroquinone

HQ-4: 2-sec-Dodecyl-5-sec-tetradecylhydoquinone

HQ-5: 2,5-Di(1,1-dimethyl-4-hexyloxycarbonyl)-butylhydroqinone

Image stabilizer A: p-t-Octylphenol

Image stabilizer B: poly(t-butyl acrylamide)

Y-1

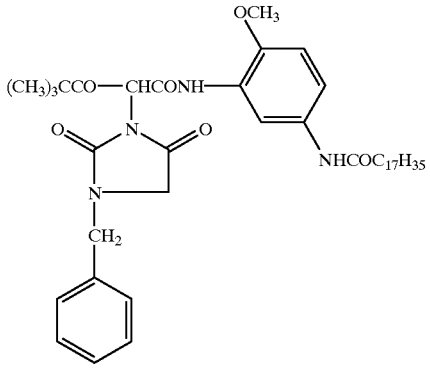

Y-2

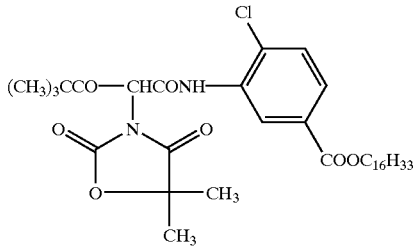

-continued
C-1
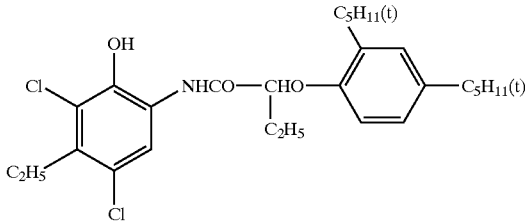
C-2
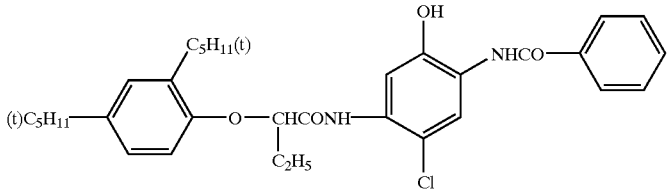
ST-1
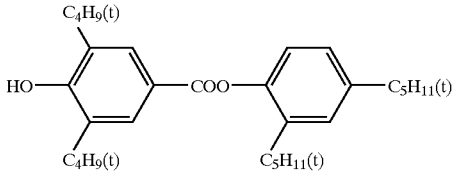
ST-2
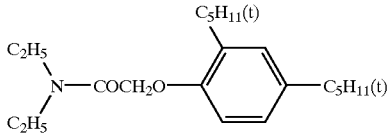
ST-3
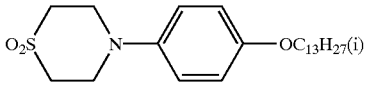
ST-4
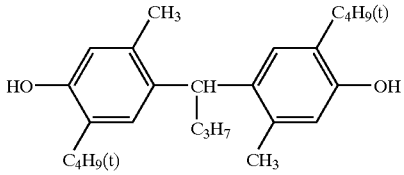
ST-5
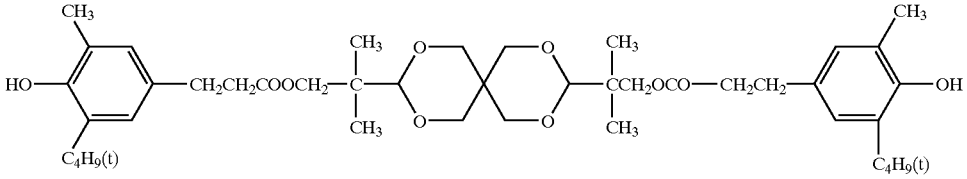
AI-1
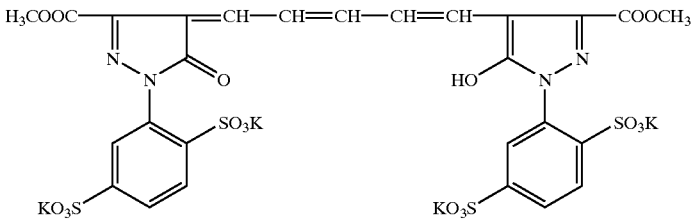
A-2
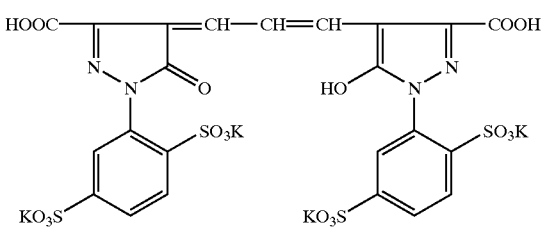
A-3
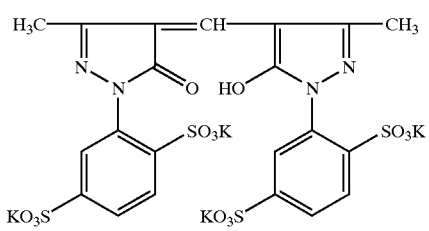

-continued

F-1

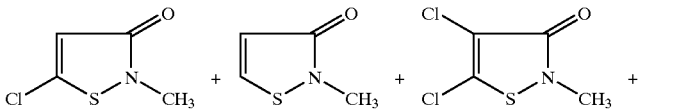

(50%) (46%) (4%) molar ratio

Mixture (molar ratio, 50:46:4)

Preparation of Blue-Sensitive Silver Halide Emulsion

There was prepared a monodisperse cubic grain emulsion (EMP-1) having an average grain size of 0.71 μm, a coefficient of variation of grain size of 0.07 and a chloride content of 99.5 mol %. Further, a monodisperse cubic grain emulsion (EMP-1B) having an average grain size of 0.38 μm, a coefficient of variation of grain size of 0.07 and a chloride content of 99.5 mol % was prepared in a manner similar to preparation of EMP-1.

The emulsion, EMP-1 was chemically sensitized using the following compounds. The emulsion, EMP-1B was also optimally chemical-sensitized in a similar manner, and then sensitized EMP-1 and EMP-1B were blended in a ratio of 1:1 based on the silver amount to obtain a blue-sensitive silver halide emulsion (Em-B).

| | |
|---|---|
| Sodium thiosulfate | 0.8 mol/mol AgX |
| Chloroauric acid | 0.5 mol/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

Preparation of Green-Sensitive Silver Halide Emulsion

Monodisperse cubic grain emulsions, EMP-2 having an average grain size of 0.40 μm, a variation coefficient of 0.08 and a chloride content of 99.5 mol % was prepared. Similarly, monodisperse cubic grain emulsion EMP-2B having an average grain size of 0.50 μm, a variation coefficient of 0.08 and a chloride content of 99.5 mol % was prepared The emulsion, EMP-2 was optimally chemical-sensitized using the following compounds. The emulsion, EMP-2B was also optimally chemical-sensitized in a similar manner, and then sensitized EMP-2 and EMP-2B emulsions were blended in a ratio of 1:1 based on the silver amount to obtain a green-sensitive silver halide emulsion (Em-G).

| | |
|---|---|
| Sodium thiosulfate | 1.5 mg/mol AgX |
| Chloroauric acid | 1.0 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizing dye GS-1 | $4 \times 10^{-4}$ mol/mol AgX |

Preparation of Red-Sensitive Silver Halide Emulsion

Monodisperse cubic grain emulsions, EMP-3 having an average grain size of 0.40 μm, a variation coefficient of 0.08 and a chloride content of 99.5 mol % was prepared. Similarly, monodisperse cubic grain emulsion EMP-3B having an average grain size of 0.38 μm, a variation coefficient of 0.08 and a chloride content of 99.5 mol % was prepared The emulsion, EMP-3 was optimally chemical-sensitized using the following compounds. The emulsion, EMP-3B was also optimally chemical-sensitized in a similar manner, and then sensitized EMP-3 and EMP-3B emulsions were blended in a ratio of 1:1 based on the silver amount to obtain a green-sensitive silver halide emulsion (Em-R).

| | |
|---|---|
| Sodium thiosulfate | 1.8 mg/mol AgX |
| Chloroauric acid | 2.0 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizing dye RS-1 | $1 \times 10^{-4}$ mol/mol AgX |
| Sensitizing dye RS-2 | $1 \times 10^{-4}$ mol/mol AgX |

STAB-1: 1-(3-Acetoamidophenyl)-5-mercaptotetrazole

STAB-2: 1-Phenyl-5-mercaptotetrazole

STAB-3: 1-(4-Ethoxyphenyl)-5-mercaptotetrazole

To the red-sensitive emulsion was added $2.0 \times 10^{-3}$ mol/mol Agx of SS-1.

BS-1

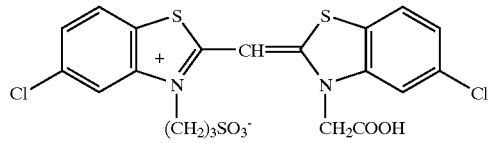

BS-2

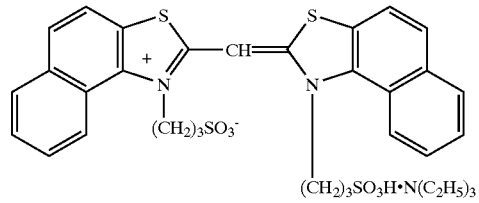

GS-1

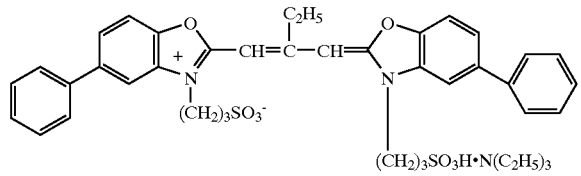

RS-1

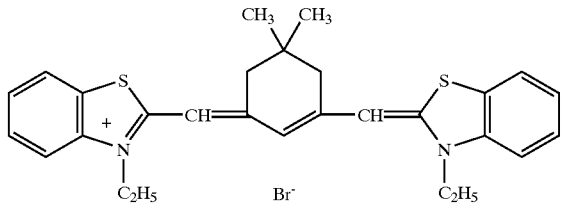

-continued

RS-2

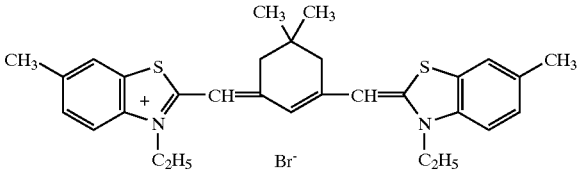

SS-1

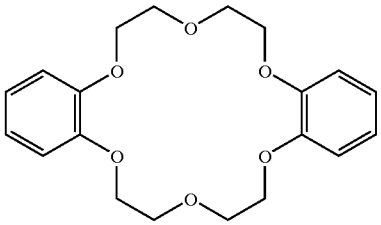

Thus prepared sample was denoted as sample No. 101. Samples Nos. 102 through 112 were prepared similarly to sample No. 101, provided that variations shown in Table 2 were made. The thus prepared samples were exposed to bule light through an optical wedge and processed according to the following process to prepare color prints having yellow wedge images. Similarly, color prints having magenta or cyan wedge images were prepared.

TABLE 1

| 1st Layer | | 3rd Layer | | 5th Layer | |
|---|---|---|---|---|---|
| Sample No. | Yellow Coupler ($g/m^2$) | Magenta Coupler ($g/m^2$) | Additive ($g/m^2$) | Cyan coupler ($g/m^2$) | Additive ($g/m^2$) |
| 101 | Y-1 (0.45) | MI-1/MIa-3 (0.05/0.15) | DIDP/DBP (0.10/0.10) | C-1/C-2 (0.22/0.06) | — |
| 102 | YI-17 (0.45) | MIa-3 (0.20) | SI-2 (0.2) | C-1/C-2 (0.22/0.06) | DBP/TCP (0.10/0.20) |
| 103 | YY-1 (0.45) | MI-1 (0.20) | SI-2 (0.20) | C-1 (0.28) | SI-2 (0.30) |
| 104 | Y-2 (0.45) | MI-5 (0.20) | SI-2 (0.20) | CI-13/CI-14 (0.27/0.03) | TCP (0.30) |
| 105 | YY-1 (0.45) | MI-5 (0.20) | TCP (0.20) | CI-13/CI-14 (0.27/0.03) | TCP (0.30) |
| 106 | YY-2 (0.45) | MI-6 (0.20) | TCP (0.20) | C-1/CC-1 (0.14/0.14) | TCP (0.30) |
| 107 | YI-17 (0.45) | MM-1 (0.20) | DBP (0.20) | CIa-5/C-1 (0.25/0.02) | SII-7 (0.30) |
| 108 | YI-17 (0.45) | MIa-3 (0.20) | SI-2 (0.20) | CIa-5/C-1 (0.25/0.02) | SII-7 (0.30) |
| 109 | YI-17 (0.45) | MIa-3 (0.20) | SI-2/UI-23 (0.20/0.06) | CIa-5/C-1 (0.25/0.02) | SII-7/UI-7 (0.30/0.06) |
| 110 | YI-17 (0.45) | MIa-3 (0.20) | SI-2 (0.20) | CI-13/CI-14 (0.27/0.03) | SII-7 (0.30) |
| 111 | Y-2 (0.45) | MI-5 (0.20) | SI-2 (0.20) | CIa-5 (0.28) | SII-7 (0.30) |
| 112 | YY-2 (0.45) | MI-6 (0.20) | SI-2 (0.20) | CIa-5 (0.28) | SII-7 (0.30) |
| 113 | YY-1 (0.45) | MI-1 (0.20) | DBP (0.20) | CC-2 (0.28) | SI-2 (0.30) |
| 114 | YY-2 (0.45) | MM-2 (0.20) | TCP (0.20) | C-1 (0.28) | TCP (0.30) |

YY-1

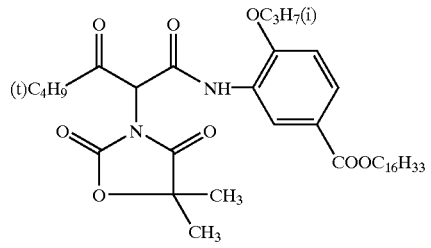

YY-2

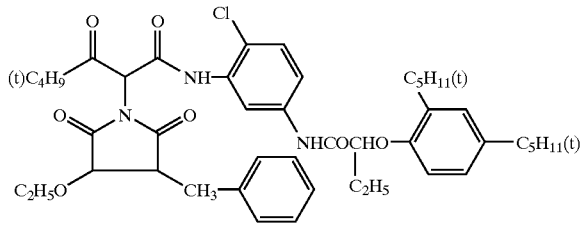

MM-1

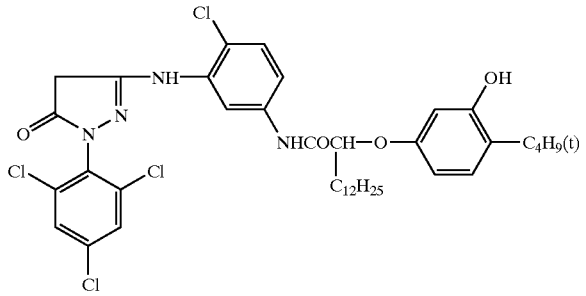

MM-2

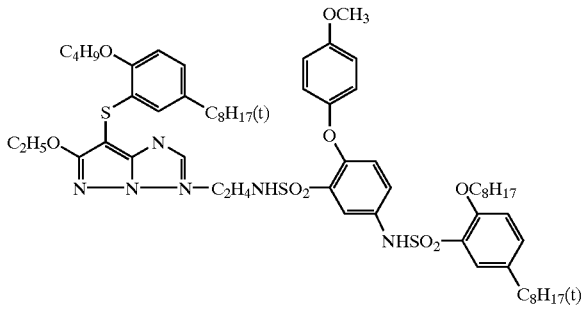

CC-1

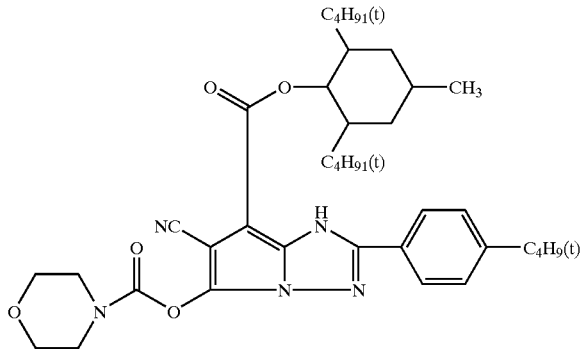

-continued

CC-2

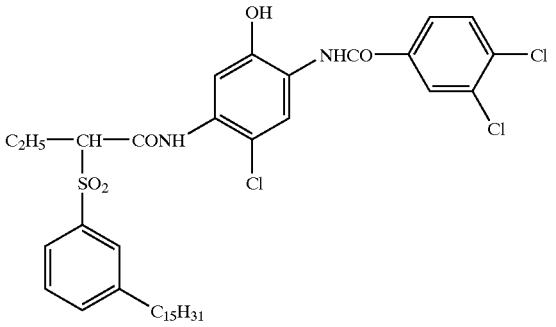

Process A

| Step | Temperature | Time | Replenishment |
|---|---|---|---|
| Color developing | 38.0 ± 0.3° C. | 30 sec. | 80 ml |
| Bleach-fixing | 35.0 ± 0.5° C. | 45 sec. | 120 ml |
| Stabilizing | 30–34° C. | 20 sec. | 150 ml |
| Drying | 60–80° C. | 30 sec. | |

Compositions of processing solutions are as follows.

Color Developer (Tank solution, Replenisher)

| | Tank soln. | Replenisher |
|---|---|---|
| Water | 800 ml | 800 ml |
| Triethylenediamine | 2 g | 3 g |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N( β-methanesulfonamidoethyl)-3-methyl-4-aminoaniline sulfate | 6.0 g | 10.0 g |
| N,N-diethylhydroxyamine | 6.8 g | 6.0 g |
| Triethanolamine | 10.0 g | 10.0 g |
| Sodium diethyltriaminepentaacetate | 2.0 g | 2.0 g |
| Brightener (4,4'-diaminostilbene-disulfonate derivative) | 2.0 g | 2.5 g |
| Potassium carbonate | 30 g | 30 g |

Water is added to make 1 liter, and the pH of the tank solution and replenisher were respectively adjusted to 10.10 and 10.60 with sulfuric acid or potassium hydroxide.

Bleach-fixer (Tank Solution, Replenisher)

| | |
|---|---|
| Ammonium diethyltriaminepentaacetate dihydrate | 65 g |
| diethyltriaminepentaacetic acid | 3 g |
| Ammonium thiosulfate (70% aqueous solution) | 100 ml |
| 2-Amino-5-mercapto-1,3,4-thiadiazole | 2.0 g |
| Ammonium sulfite (40% aqueous solution) | 27.5 ml |

Water is added to make 1 liter, and the pH is adjusted to 5.0.

Stabilizer (Tank Solution, Replenisher)

| | |
|---|---|
| o-Phenylphenol | 1.0 g |
| 5-Chloro-2-methyl-4-isothiazoline-3-one | 0.02 g |
| 2-Methyl-4-isothiazoline-3-one | 0.02 g |
| Diethylene glycol | 1.0 g |
| Brightener (Chinopal SFP) | 2.0 g |
| 1-Hydroxyethylidene-1,1-diphosphonic acid | 1.8 g |
| Bismuth chloride (45% aqueous solution) | 0.65 g |
| Magnesium sulfate heptahydrate | 0.2 g |
| Polyvinyl pyrrolidine (PVP) | 1.0 g |
| Ammonia water (25% aqueous ammonium hydroxide solution) | 2.5 g |
| Trisodium nitrilotriacetate | 1.5 g |

Water is added to make 1 liter, and the pH is adjusted to 7.5 with sulfuric acid or potassium hydroxide.

Further, the processing time was varied as follows:

Process B

| Step | Temperature | Time | Replenishment |
|---|---|---|---|
| Color developing | 38.0 ± 0.3° C. | 18 sec. | 80 ml |
| Bleach-fixing | 35.0 ± 0.5° C. | 19 sec. | 120 ml |
| Stabilizing | 30–34° C. | 16 sec. | 150 ml |
| Drying | 60–80° C. | 27 sec. | |

Processing was conducted using an apparatus in processing B described in Example 1 of JP-A 11-15117, in which a processing solution was coated with supplying the processing solution from a solution-supplying head (denoted as processing C). Furthermore, processing was conducted similarly to process C, provided that the solution-supplying head was replaced by an array-form supplying head of piezo-type ink-jet printing, in which the processing solution was supplied through a gas phase (denoted as process D).

The obtained color print samples were measured with respect to spectral reflection absorption, using Color Analyzer Type 607, available from Hitachi, Ltd. From the absorption spectrum for the portion having 1.0 of the absorbance at the absorption maximum in the obtained color print, the wavelength at the absorption maximum, λmax(Y) was determined. Similarly, exposure to green or red light and processing were conducted, and from the obtained spectral absorption, λmax(M), λmax(C), $Abs_{600}$(M) and $Abs_{550}$(C) are determined, as shown in Table 2.

TABLE 2

| Sample No. | $\lambda_{max}$ (M) − $\lambda_{max}$ (Y) | $\lambda_{max}$ (C) − $\lambda_{max}$ (M) | $Abs_{600}$ (M) | $Abs_{550}$ (C) |
|---|---|---|---|---|
| 101 (Comp.) | 107 | 104 | 0.44 | 0.50 |
| 102 (Comp.) | 105 | 100 | 0.41 | 0.50 |
| 103 (Comp.) | 103 | 107 | 0.41 | 0.49 |
| 104 (Comp.) | 98 | 83 | 0.39 | 0.38 |
| 105 (Comp.) | 105 | 83 | 0.39 | 0.38 |
| 106 (Comp.) | 98 | 98 | 0.40 | 0.43 |
| 107 (Comp.) | 91 | 85 | 0.44 | 0.43 |
| 108 (Inv.) | 105 | 71 | 0.41 | 0.45 |
| 109 (Inv.) | 106 | 70 | 0.40 | 0.37 |
| 110 (Inv.) | 105 | 79 | 0.41 | 0.38 |
| 111 (Inv.) | 98 | 75 | 0.39 | 0.46 |

TABLE 2-continued

| Sample No. | $\lambda_{max}$ (M) − $\lambda_{max}$ (Y) | $\lambda_{max}$ (C) − $\lambda_{max}$ (M) | $Abs_{600}$ (M) | $Abs_{550}$ (C) |
|---|---|---|---|---|
| 112 (Inv.) | 98 | 75 | 0.40 | 0.46 |
| 113 (Comp.) | 94 | 86 | 0.39 | 0.48 |
| 114 (Comp.) | 98 | 99 | 0.41 | 0.51 |

Processed samples were each evaluated with respect to color gamut and dependency on light source for visual appreciation.

Color Gamut

From the obtained spectral reflection absorption for each of yellow, magenta and cyan, a color gamut in the a*b* plane at L*=50 in CIE 1976 L*a*b* color space was calculated according to the method described in JP-A 6-202287. The calculated value for color gamut was represented by a relative value, based on the value of sample No. 101 being 100. The higher the value, the better the color gamut.

Dependency on Light Source for Visual Appreciation

Dependency on light source for visual appreciation was evaluated in the following manner. Thus, sample Nos. 101 through 114 were each exposed to light through a filter and processed according to the foregoing process to obtain neutral color image samples. The thus obtained samples were measured using Color Analyzer Type 607, available from Hitachi, Ltd. and from calculated tristimulus values X, Y and Z, L*, a* and b* were determined according to the method defined in JIS Z 8729-1980. Then, according to the following formula, ΔE was determined:

$$\Delta E=[(L^*_1-L^*_2)^2+(a^*_1-a^*_2)^2+(b^*_1-b^*_2)^2]^{1/2}$$

where ($L^*_1$, $a^*_1$, $b^*_1$) represents a (L*,a*,b*) value calculated using standard light source C of JIS Z 8729-1980 as a light source for colorimetry, and ($L^*_2$, $a^*_2$, $b^*_2$) represents a (L*,a*,b*) value calculated using a 3-band type fluorescent lamp EX-N as a light source for colorimetry. The higher this ΔE value, the less the dependency of light source in the invention. In Table 3 are shown color gamut and E for samples 101 through 114, in which the color gamut is represented by a relative value, based on that of sample 101 being 100.

Visual Evaluation of Color Gamut and Dependency on Light Source for Visual Appreciation Using a negative film and each of the samples, color prints were prepared. The color gamut of each of the obtained prints was visually evaluated by ten persons under a fluorescent lamp EDL light source for evaluation. Evaluation was based on seven grades of "1" through "7" and the higher values indicate superior color reproduction. Evaluation results are shown in Table 4. In samples having an average evaluation of 5 or more, an improvement in color gamut was noticed. With respect to dependency on the light source for visual appreciation, the print samples were visually evaluated by ten randomly selected persons under each of the three light sources, a fluorescent lamp for use in color evaluation, an EDL and a 3-band type fluorescent lamp, EX-N. Evaluation was based on seven grades of "1" to "7" with the higher values indicating reduced dependence on the light source. Evaluation results are shown in Table 3. In samples having obtained an average evaluation point of 5 or more, an improvement in light source dependence was noticed.

TABLE 3

| Sample No. | Color Gamut | Visual Evaluation | ΔE | Visual Evaluation |
|---|---|---|---|---|
| 101 (Comp.) | 100 | 1 | 3.5 | 2 |
| 102 (Comp.) | 102 | 3 | 3.6 | 2 |
| 103 (Comp.) | 103 | 3 | 4.0 | 1 |
| 104 (Comp.) | 110 | 6 | 2.8 | 3 |
| 105 (Comp.) | 112 | 7 | 3.3 | 2 |
| 106 (Comp.) | 108 | 4 | 2.2 | 4 |
| 107 (Comp.) | 95 | 1 | 2.0 | 6 |
| 108 (Inv.) | 112 | 7 | 1.6 | 7 |
| 109 (Inv.) | 120 | 9 | 1.3 | 9 |
| 110 (Inv.) | 114 | 7 | 1.8 | 6 |
| 111 (Inv.) | 111 | 6 | 1.7 | 7 |
| 112 (Inv.) | 110 | 6 | 1.7 | 7 |
| 113 (Comp.) | 107 | 4 | 2.5 | 4 |
| 114 (Comp.) | 101 | 2 | 2.4 | 4 |

As can be seen from Table 3, it was proved that in sample Nos. 104 or 106, a bathochromic shift of a magenta coupler dye and a hypsochromic shift of a cyan coupler dye, i.e., the difference of $\lambda_{max}$(C)−$\lambda_{max}$(M) was insufficient and did not reach the desired level. It was further proved that Nos. 108 to 112 comprising the photographic element having the combination of yellow, magenta and cyan couplers of the invention, the $Abs_{600}$(M) fell within the range of 0.38 to 0.43, achieving a sufficient bathochromic shift of a magenta coupler dye and the $Abs_{550}$(C) fell within the range of 0.35 to 0.48, achieving a sufficient hypsochromic shift of a cyan coupler dye, thereby leading to improvements in color gamut and light source dependence. It is to be specifically noted that in sample Nos. 108 and 109, $Abs_{550}$(C) fell within the range of 0.40 to 0.45, resulting in marked improvement in color gamut and light source dependence.

Further, the processing time was varied as follows:

Process B

| Step | Temperature | Time | Replenishment |
|---|---|---|---|
| Color developing | 38.0 ± 0.3° C. | 18 sec. | 80 ml |
| Bleach-fixing | 35.0 ± 0.5° C. | 19 sec. | 120 ml |
| Stabilizing | 30–34° C. | 16 sec. | 150 ml |
| Drying | 60–80° C. | 27 sec. | |

Processing was also conducted using an apparatus in process B described in Example 1 of JP-A 11-15117, in which a processing solution was coated with supplying the processing solution from a solution-supplying head (denoted as processing C). Furthermore, processing was conducted similarly to process C, provided that the solution-supplying head was replaced by an array-form supplying head of piezo-type ink-jet printing, in which the processing solution was supplied through a gas phase (denoted as process D).

Samples 101 through 114 were processed in each of the process B, process C and process D and similarly evaluated. As a result, it was proved that similar results were obtained with respect to color gamut and dependence on light source for visual appreciation.

Example 2

Samples were prepared similarly to Example 1. The prepared samples were processed using automatic processor NPS-868J, processing chemicals ECOJET-P and process CPK-2-J1 (each, available from Konica Corp.). Similarly to Example 1, samples according to the invention led to desired effects of the invention.

Example 3

Samples were prepared similarly to Example 1. The prepared samples were processed using automatic processor QDP-1500, ECOJET-HQA-P as the processing chemicals and process CPK-HQA-P (each, available from Konica Corp.). Similarly to Example 1, samples according to the invention led to the advantageous effects of the invention.

Example 4

There were prepared silver halide photographic materials comprising a transparent polyester film support having thereon the photographic elements of Example 1. Similarly to Example 1, print samples were prepared using a negative film and evaluated with respect to color gamut and light source dependence. As a result, improvements in color gamut and light dependence were achieved.

What is claimed is:

1. A photographic element comprising a yellow dye forming coupler, a magenta dye forming coupler and a cyan dye forming coupler, wherein spectral reflection absorption characteristics of a yellow dye, a magenta dye and a cyan dye which are formed of the yellow dye forming coupler, the magenta dye forming coupler and the cyan dye forming coupler, respectively, meet the following requirements:

$$110 \geqq \lambda\max(M) - \lambda\max(Y) \geqq 95,$$

$$80 \geqq \lambda\max(C) - \lambda\max(M) \geqq 70,$$

$$0.43 \geqq Abs_{600}(M) \geqq 0.38,$$

and $$0.48 \geqq Abs_{550}(C) \geqq 0.35,$$

wherein λmax(Y) is a wavelength at an absorption maximum of the yellow dye, λmax(M) is a wavelength at an absorption maximum of the magenta dye and λmax(C) is a wavelength at an absorption maximum of the cyan dye; $Abs_{600}$ (M) is an absorbance at a wavelength of 600 nm of the magenta dye having 1.0 of an absorbance at the absorption maximum and Abs550 (C) is an absorbance at a wavelength of 550 nm of the cyan dye having 1.0 of an absorbance at the absorption maximum.

2. The photographic element of claim 1, wherein spectral reflection absorption characteristics of a yellow dye, a magenta dye and a cyan dye which are formed of the yellow coupler, the magenta coupler and the cyan coupler, respectively, meet the following requirements:

$$108 \geqq \lambda\max(M) - \lambda\max(Y) \geqq 100,$$

$$80 \geqq \lambda\max(C) - \lambda\max(M) \geqq 70,$$

$$0.42 \geqq Abs_{600}(M) \geqq 0.40,$$

and $$0.46 \geqq Abs_{550}(C) \geqq 0.35,$$

wherein λmax(Y) is a wavelength at an absorption maximum of the yellow dye, λmax(M) is a wavelength at an absorption maximum of the magenta dye and λmax(C) is a wavelength at an absorption maximum of the cyan dye; $Abs_{600}$ (M) is an absorbance at a wavelength of 600 nm of the magenta dye having 1.0 of an absorbance at the absorption maximum and $Abs_{550}$ (C) is an absorbance at a wavelength of 550 nm of the cyan dye having 1.0 of an absorbance at the absorption maximum.

3. A silver halide photographic light sensitive material comprising on a support a blue-sensitive silver halide emulsion layer containing at least one yellow dye forming coupler, a green-sensitive silver halide emulsion layer containing at least one magenta dye forming coupler and a red-sensitive silver halide emulsion layer containing at least one cyan dye forming coupler, wherein spectral reflection absorption characteristics of a yellow dye, a magenta dye and a cyan dye which are formed of the yellow dye forming coupler, the magenta dye forming coupler and the cyan dye forming coupler, respectively, meet the following requirements:

$$110 \geqq \lambda\max(M) - \lambda\max(Y) \geqq 95,$$

$$80 \geqq \lambda\max(C) - \lambda\max(M) \geqq 70,$$

$$0.43 \geqq Abs_{600}(M) \geqq 0.38,$$

and $$0.48 \geqq Abs_{550}(C) \geqq 0.35,$$

wherein λmax(Y) is a wavelength at an absorption maximum of the yellow dye, λmax(M) is a wavelength at an absorption maximum of the magenta dye and λmax(C) is a wavelength at an absorption maximum of the cyan dye; $Abs_{600}$ (M) is an absorbance at a wavelength of 600 nm of the magenta dye having 1.0 of an absorbance at the absorption maximum and $Abs_{550}$ (C) is an absorbance at a wavelength of 550 nm of the cyan dye having 1.0 of an absorbance at the absorption maximum.

4. The silver halide photographic material of claim 3, wherein the magenta dye forming coupler is represented by formula (M-I) and the green-sensitive layer further containing a compound represented by formula (S-I) in an amount of 30 to 150% by weight, based on total magenta coupler(s); the cyan dye forming coupler is represented by formula (C-I) and the red-sensitive layer further containing a compound represented by formula (S-II) in an amount of 30 to 150% by weight, based on total cyan coupler(s):

formula (M-I)

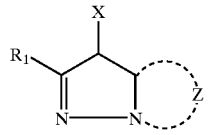

wherein $R_1$ is a hydrogen atom or a substituent group; X is a hydrogen atom or a group capable of being released upon reaction with an oxidation product of a color developing agent; and Z is a non-metallic atom group necessary to form a nitrogen-containing heterocyclic ring;

$R_2$—OH formula (S-I)

wherein $R_2$ is a substituent group having 11 to 30 carbons including at least one unsaturated carbon;

formula (C-I)

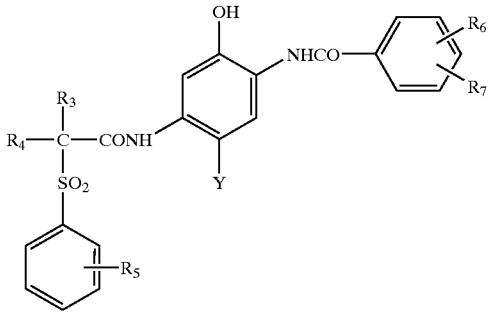

wherein $R_3$ and $R_4$ are each a hydrogen atom or an alkyl group; $R_5$, $R_6$ and $R_7$ are each a hydrogen atom, an alkyl group, an alkoxy group or a halogen atom; Y is a hydrogen atom or a group capable of being released upon reaction with an oxidation product of a color developing agent;

formula (S-II)

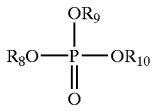

wherein $R_8$, $R_9$ and $R_{10}$ are each an alkyl group having 6 to 20 carbons.

5. The silver halide photographic material of claim 4, wherein the yellow dye forming coupler is represented by the following formula (Y-I):

formula (Y-I)

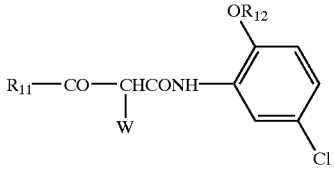

wherein $R_{11}$ is an aliphatic group or an aromatic group; W is a 5- or 6-membered nitrogen containing heterocyclic group capable of being released upon reaction with an oxidation product of a color developing agent; and $R_{12}$ is a ballasted aliphatic group or a ballasted aromatic group.

6. The silver halide photographic material of claim 5, wherein the magenta dye forming coupler is represented by formula (M-Ia) and the cyan dye forming coupler being represented by formula (C-Ia):

formula (M-Ia)

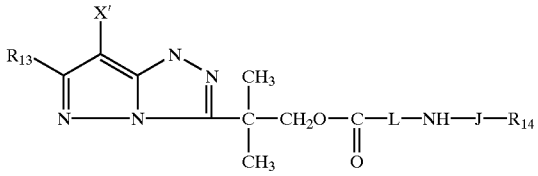

wherein $R_{13}$ is a hydrogen atom or a substituent group; $R_{14}$ is a hydrogen atom or an alkyl group, a cycloalkyl group or an aryl group; X' is a hydrogen atom or a group capable being released upon reaction with an oxidation product of a color developing agent; L is an alkylene group; and J is —CO— or —$SO_2$—;

formula (C-Ia)

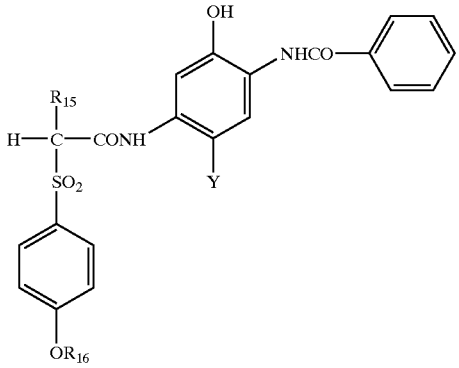

wherein $R_{15}$ is a hydrogen atom or an alkyl group; $R_{16}$ is an alkyl group having 10 to 20 carbon atoms; and Y is a hydrogen atom or a group capable of being released upon reaction with an oxidation product of a color developing agent.

7. The silver halide photographic material of claim 6, wherein the green-sensitive layer further contains a compound represented by formula (U-1) in an amount of 20 to 100% by weight, based on total magenta dye forming coupler(s):

formula (U-1)

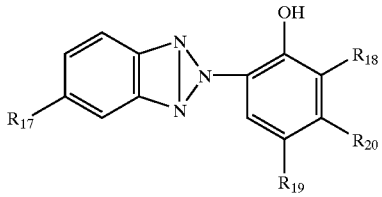

wherein $R_{17}$, $R_{18}$ and $R_{19}$ are each a hydrogen atom, a halogen atom, an alkyl group, an alkoxy group or an aryl group; $R_{20}$ is a hydrogen atom, an alkyl group, an alkoxy group, an aryloxy group, an acylamino group, a sulfonamido group or a ureido group.

8. The silver halide photographic material of claim 7, wherein the red-sensitive layer further contains a compound represented by formula (U-I) in an amount of 20 to 100% by weight, based on total cyan dye forming coupler(s):

formula (U-I)

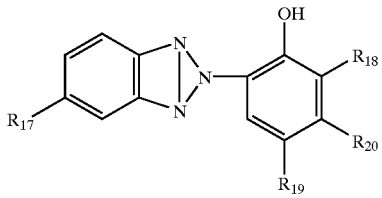

wherein $R_{17}$, $R_{18}$ and $R_{19}$ are each a hydrogen atom, a halogen atom, an alkyl group, an alkoxy group or an aryl group; $R_{20}$ is a hydrogen atom, an alkyl group, an alkoxy group, an aryloxy group, an acylamino group, a sulfonamido group or a ureido group.

9. A silver halide photographic light sensitive material comprising on a support a blue-sensitive silver halide emulsion layer containing at least one yellow dye forming coupler, a green-sensitive silver halide emulsion layer containing at least one magenta dye forming coupler and a red-sensitive silver halide emulsion layer containing at least one cyan dye forming coupler, wherein spectral reflection absorption characteristics of a yellow dye, a magenta dye and a cyan dye which are formed of the yellow dye forming coupler, the magenta dye forming coupler and the cyan dye forming coupler, respectively, meet the following requirements:

$$108 \geqq \lambda max(M) - \lambda max(Y) \geqq 100,$$

$$80 \geqq \lambda max(C) - \lambda max(M) \geqq 70,$$

$$0.42 \geqq Abs_{600}(M) \geqq 0.40,$$

and $$0.46 \geqq Abs_{550}(C) \geqq 0.35,$$

wherein λmax(Y) is a wavelength at an absorption maximum of the yellow dye, λmax(M) is a wavelength at an absorption maximum of the magenta dye and λmax(C) is a wavelength at an absorption maximum of the cyan dye; $Abs_{600}$ (M) is an absorbance at a wavelength of 600 nm of the magenta dye having 1.0 of an absorbance at the absorption maximum and $Abs_{550}$ (C) is an absorbance at a wavelength of 550 nm of the cyan dye having 1.0 of an absorbance at the absorption maximum.

10. The silver halide photographic material of claim 9, wherein the magenta dye forming coupler is represented by formula (M-I) and the green-sensitive layer further containing a compound represented by formula (S-I) in an amount of 30 to 150% by weight, based on total magenta dye forming coupler(s); the cyan dye forming coupler is represented by formula (C-I) and the red-sensitive layer further containing a compound represented by formula (S-II) in an amount of 30 to 150% by weight, based on total cyan dye forming coupler(s):

formula (M-I)

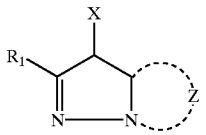

wherein $R_1$ is a hydrogen atom or a substituent group; X is a hydrogen atom or a group capable of being released upon reaction with an oxidation product of a color developing agent; and Z is a non-metallic atom group necessary to form a nitrogen-containing heterocyclic ring;

$R_2$—OH formula (S-I)

wherein $R_2$ is a substituent group having 11 to 30 carbons including at least one unsaturated carbon;

formula (C-I)

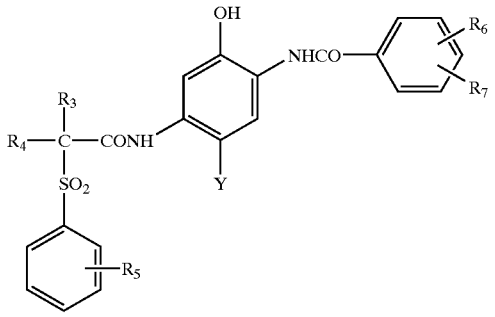

wherein $R_3$ and $R_4$ are each a hydrogen atom or an alkyl group; $R_5$, $R_6$ and $R_7$ are each a hydrogen atom, an alkyl group, an alkoxy group or a halogen atom; Y is a hydrogen atom or a group capable of being released upon reaction with an oxidation product of a color developing agent;

formula (S-II)

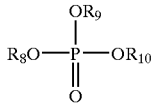

wherein $R_8$, $R_9$ and $R_{10}$ are each an alkyl group having 6 to 20 carbons.

11. The silver halide photographic material of claim 10, wherein the yellow dye forming coupler is represented by the following formula (Y-I):

formula (Y-I)

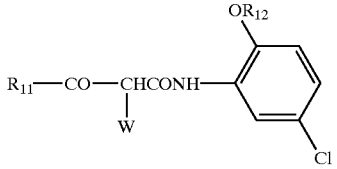

wherein $R_{11}$ is an aliphatic group or an aromatic group; W is a 5- or 6-membered nitrogen containing heterocyclic group capable of being released upon reaction with an oxidation product of a color developing agent; and $R_{12}$ is a ballasted aliphatic group or a ballasted aromatic group.

12. The silver halide photographic material of claim 11, wherein the magenta dye forming coupler is represented by formula (M-Ia) and the cyan dye forming coupler being represented by formula (C-Ia):

formula (M-Ia)

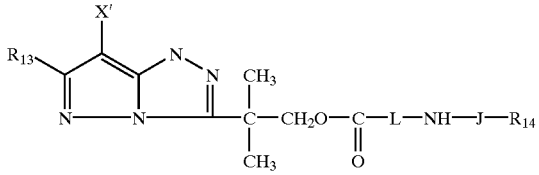

wherein $R_{13}$ is a hydrogen atom or a substituent group; $R_{14}$ is a hydrogen atom or an alkyl group, a cycloalkyl group or an aryl group; X' is a hydrogen atom or a group capable of being released upon reaction with an oxidation product of a color developing agent; L is an alkylene group; and J is —CO— or —$SO_2$—;

formula (C-Ia)

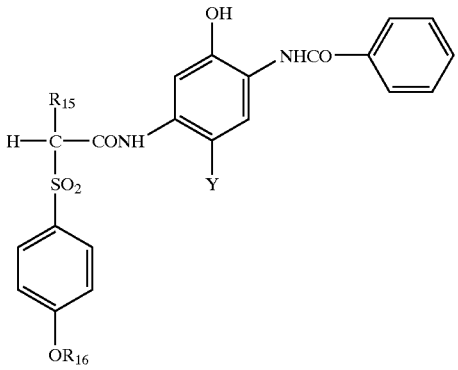

wherein $R_{15}$ is a hydrogen atom or an alkyl group; $R_{16}$ is an alkyl group having 10 to 20 carbon atoms; and Y is a hydrogen atom or a group capable of being released from the coupler upon reaction with an oxidation product of a color developing agent.

13. The silver halide photographic material of claim 12, wherein the green-sensitive layer further contains a compound represented by formula (U-I) in an amount of 20 to 100% by weight, based on total magenta dye forming coupler(s):

formula (U-I)

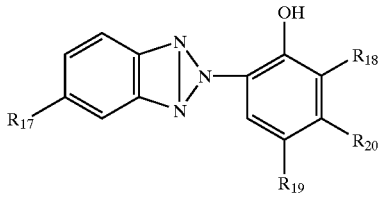

wherein $R_{17}$, $R_{18}$ and $R_{19}$ are each a hydrogen atom, a halogen atom, an alkyl group, an alkoxy group or an aryl group; $R_{20}$ is a hydrogen atom, an alkyl group, an alkoxy group, an aryloxy group, an acylamino group, a sulfonamido group or a ureido group.

14. The silver halide photographic material of claim 12, wherein the red-sensitive layer further contains a compound represented by formula (U-I) in an amount of 20 to 100% by weight, based on total cyan dye forming coupler(s):

formula (U-I)

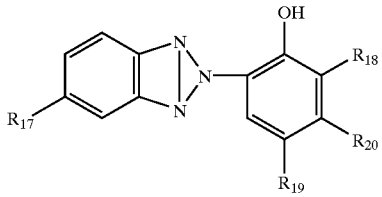

wherein $R_{17}$, $R_{18}$ and $R_{19}$ are each a hydrogen atom, a halogen atom, an alkyl group, an alkoxy group or an aryl group; $R_{20}$ is a hydrogen atom, an alkyl group, an alkoxy group, an arloxy group, an acylamino group, a sulfonamido group or a ureido group.

* * * * *